United States Patent [19]

Nakajima et al.

[11] Patent Number: 4,744,731

[45] Date of Patent: May 17, 1988

[54] VARIABLE CAPACITY VANE COMPRESSOR

[75] Inventors: Nobuyuki Nakajima; Kenichi Inomata; Shigeru Okada; Kazuo Eitai, all of Konan, Japan

[73] Assignee: Diesel Kiki Co., Ltd., Japan, Japan

[21] Appl. No.: 68,554

[22] Filed: Jul. 1, 1987

[30] Foreign Application Priority Data

| | | | |
|---|---|---|---|
| Jul. 7, 1986 | [JP] | Japan | 61-159310 |
| Sep. 17, 1986 | [JP] | Japan | 61-142362[U] |
| Oct. 16, 1986 | [JP] | Japan | 61-246027 |
| Dec. 19, 1986 | [JP] | Japan | 61-195583[U] |

[51] Int. Cl.[4] ..... F04B 49/02; F04C 29/08

[52] U.S. Cl. ..... 417/295; 417/310

[58] Field of Search ..... 417/295, 310, 440; 418/15, 78

[56] References Cited

U.S. PATENT DOCUMENTS

| | | | |
|---|---|---|---|
| 3,206,218 | 9/1965 | Potter | 91/482 |
| 4,621,986 | 11/1986 | Sudo | 418/304 |

FOREIGN PATENT DOCUMENTS

| | | | |
|---|---|---|---|
| 174516 | 3/1986 | European Pat. Off. | 417/310 |
| 137813 | 2/1984 | Japan | 417/270 |
| 196991 | 11/1984 | Japan | 417/310 |

*Primary Examiner*—William L. Freeh

*Attorney, Agent, or Firm*—Charles S. McGuire

[57] ABSTRACT

A variable capacity vane compressor comprising a control element having at least one pressure-receiving protuberance dividing a space into a first and a second pressure chamber, wherein the control element angularly moves in response to a differential pressure between the first and second pressure chambers, to vary an opening angle of a second portion of at least one inlet port. The control element has mounted thereon a sealing member for sealing between the first and second pressure chambers and between a low pressure chamber and a vane back pressure zone. The sealing member comprises a first sealing portion for sealing between a peripheral wall surface of a central bore in the control element and an inner peripheral side wall surface of an annular recess in a side block, a second sealing portion for sealing between an outer peripheral surface of the control element and an outer peripheral side wall surface of the annular recess, a third sealing portion for sealing between an outer peripheral edge of the pressure-receiving protuberance and the wall surface of the space, and a fourth sealing portion for sealing between an axial end face of the control element and a bottom wall surface of the annular recess.

11 Claims, 20 Drawing Sheets

VARIABLE CAPACITY VANE COMPRESSOR

BACKGROUND OF THE INVENTION

This invention relates to variable capacity vane compressors which are adapted for use as refrigerant compressors of air conditioners for automotive vehicles.

A variable capacity vane compressor is known e.g. by Japanese Provisional Utility Model Publication (Kokai) No. 55-2000 filed by the same assignee of the present application, which is capable of controlling the capacity of the compressor by varying the suction quantity of a gas to be compressed. According to this known vane compressor, arcuate slots are formed in a peripheral wall of the cylinder and each extend from a lateral side of a refrigerant inlet port formed through the same peripheral wall of the cylinder and also through an end plate of the cylinder, and in which is slidably fitted a throttle plate, wherein the effective circumferential length of the opening of the refrigerant inlet port is varied by displacing the throttle plate relative to the slot so that the compression commencing position in a compression chamber defined in the cylinder varies and accordingly the compression stroke period varies to thereby vary the capacity or delivery quantity of the compressor. A link member is coupled at one end to the throttle plate via a support shaft secured to the end plate, and at the other end to an actuator so that the link member is pivotally displaced by the actuator to displace the throttle plate.

However, according to the conventional vane compressor, because of the intervention of the link member between driving means or the actuator and a control member or the throttle plate for causing displacement of the throttle plate, the throttle plate undergoes a large hysteresis, leading to low reliability in controlling the compressor capacity, and also the capacity control mechanism using the link member, etc. requires complicated machining and assemblage.

Further, a variable capacity vane compressor which has a reduced hysteresis of the control member has been proposed by Japanese Provisional Patent Publication (Kokai) No. 61-232397 filed by the same assignee of the present application, which provides an improvement in a vane compressor comprising a cylinder formed of a cam ring and a pair of side blocks closing opposite ends of the cam ring, a rotor rotatably received within the cylinder, a plurality of vanes radially slidably fitted in respective slits formed in the rotor, a control member disposed for displacement in a refrigerant inlet port formed in one of the side blocks, and driving means for causing the control member to be displaced relative to the refrigerant inlet port, whereby the capacity or delivery quantity of the compressor can be varied by displacement of the control member. The improvement comprises driven teeth provided on the control member, and driving teeth provided on an output shaft of the driving means in mating engagement with the driven teeth, whereby the control member is driven directly by the driving means through the mating driving and driven teeth.

However, according to this conventional vane compressor, a stepping motor as the driving means is mounted within the compressor housing, requiring a large space for accommodation of the stepping motor, and the capacity control mechanism has an overall complicated construction and accordingly is high in manufacturing cost.

A variable capacity vane compressor attempting to improve the above-discussed problems has been proposed by Japanese Utility Model Application No. 60-183319 filed by the same assignee of the present application, which provides an improvement in a vane compressor comprising a cam ring having opposite axial ends closed by respective side blocks, a rotor rotatably received in the cam ring, and vanes slidably fitted in respective vane slits formed in the rotor, wherein fluid is compressed by change in volume of compression chambers respectively difined by the rotor and the adjacent vanes. The improvement comprises a pair of second inlet ports provided in one of the side blocks which has the inlet port, a pair of spaces provided in the one side block and communicating with a low pressure zone and a high pressure zone, a control element having a pair of pressure-receiving protuberances axially projecting from axial one end face of the control element, each of the pressure-receiving protuberances being slidably fitted in a corresponding one of the spaces to divide the space into a first pressure chamber communicating with the low pressure zone and a second pressure chamber communicating with the high pressure zone, the control element being fitted in an annular recess provided in the one side block for angular movement in opposite circumferential directions, for controlling opening angles of the respective second inlet ports, an integrally molded sealing member formed of an elastic rubber and mounted to the control element for sealing between the respective first pressure chambers and the respective second pressure chambers and between the low pressure zone and a zone of a back pressure acting upon the vanes, a communication passageway communicating the respective second pressure chambers with the low pressure zone, and a control valve device provided in the communication passageway and operable to close same when the pressure in the low pressure zone is above a predetermined value and to open the communication passageway when the pressure in the low pressure zone is below the predetermined value, wherein the control element angularly moves in response to the differential pressure between the first and second pressure chambers to control the opening degrees of the respective second inlet ports, to thereby control the compression commencing timing to vary the capacity or delivery quantity of the compressor.

However, the above-described conventional variable capacity vane compressor has such a problem that a hysteresis is large between the rotative shift of the control element toward the full capacity operation side (the side of increase in delivery quantity) and the rotative shift of the control element toward the partial capacity operation side (the side of decrease in delivery quantity). The reason for this is that torque due to the resistance of the sealing member, i.e., seal resistance acts as a reaction force against torque acting upon the control element when shifting toward the full capacity operation side (torque due to the pressure within the second pressure chambers of the respective spaces, hereinafter referred to as "pressure torque"), and against torque acting upon the control element when shifting toward the partial capacity operation side (torque due to a spring urging the control element toward the partial capacity operation side, hereinafter referred to as "spring torque"). The torque due to the seal resistance causes the hysteresis.

In order to reduce the hysteresis, the "pressure torque" and "spring torque" against the seal resistance torque should respectively be increased.

In order to increase the former "pressure torque", it is required to increase control pressure acting upon the control element, i.e., the pressure within the second pressure chambers of the respective spaces, or to increase the pressure-receiving areas of the respective pressure-receiving protuberances. In this connection, the pressure within the second pressure chambers of the respective spaces, which is the aforesaid control pressure, is determined dependent upon the cooling cycle, and the force of the spring is set to a value corresponding to the control pressure. Therefore, it becomes necessary to increase the pressure-receiving areas of the respective pressure-receiving protuberances.

The sealing member in the variable capacity vane compressor according to the aforementioned Japanese Utility Model Application No. 60-183319 comprises, as shown in FIG. 1 of the accompanying drawings, a first annular sealing portion 80*a* fitted in a groove 83 formed in the axial one end face of the control element 81 and extending along a peripheral edge of a central bore 82 formed in the control element 81, for sealing between a central portion of the axial one end face of the control element 81 and a bottom wall surface of an annular recess formed in the side block, not shown, a pair of second sealing portions 80*b* in the form of an arc concentric with the first sealing portion 80*a* and fitted respectively in a pair of grooves 84 provided along an outer peripheral edge of the axial one end face of the control element 81 for sealing between the outer peripheral portion of the axial one end face of the control element 81 and the bottom wall surface of the annular recess in the side block, a pair of third sealing portions 80*c* in the form of a flat plate and provided in a manner integral with respective ends of the respective second sealing portions 80*b* and the first sealing portion 80*a* to connect them with other, the third sealing portions 80*c* being fitted respectively in grooves 86 formed in the respective pressure-receiving protuberances 85 on the control element 81 for sealing between the outer peripheral side surfaces of the respective pressure-receiving protuberances 85, and the annular recess and the spaces in the side block, and a pair of fourth sealing portions 80*d* provided in a manner integral with the respective other ends of the respective second sealing portions 80*b* and the first sealing portion 80*a* to connect them with each other, the fourth sealing portions 80*d* being fitted respectively in a pair of generally radially extending prooves 87 formed in the axial one end face of the control element 81 to seal between the axial one end face of the control element 81 and the bottom wall surface of the annular recess in the side block. That is, since the sealing structure for the control element 81 is of a plane seal at only the axial one end face thereof, the pressure-receiving protuberances 85 must be disposed between the first sealing portion 80*a* and the respective second sealing portions 80*b*. In order to increase the pressure-receiving areas of the respective pressure-receiving protuberances 85, it is required to increase the axially protruding length $L_1$ of each protuberance 85, or to increase the lateral width $L_2$ thereof. However, if the protruding length $L_1$ is increased, the compressor is increased in axial length correspondingly. On the other hand, the increase in the lateral width $L_2$ results in increase in the length of the longitudinal side of each third sealing portion 80*c* of the sealing member 80, the length of each fourth sealing portion 80*d*, and the length of each second sealing portion 80*b*. This increases the sealing line length along these portions, causing increase in the seal resistance. Accordingly, it is not possible to increase the pressure-receiving areas of the respective pressure-receiving protuberances 85 without increase in the axial length of the compressor and without increase in the sealing line length. Further, the sizes or dimensions La, Lb and Lc of various portions of the sealing member 80 must be controlled, so that high precision is required for the manufacture of the sealing member 80.

Moreover, all of the sealing surfaces of the respective portions of the sealing member 80 are located at the axial one end face or front face of the control element 81. Therefore, if the control element 81 is subjected to an axial force due to the pressure acting thereupon and is displaced axially, the urging force acting upon the sealing member 80 varies, causing change in the air-tightness due to the sealing member 80 and the slidability of the control element 81.

SUMMARY OF THE INVENTION

It is an object of the invention to provide a variable capacity vane compressor in which a variable capacity control mechanism is made simple in construction and compact in size to thereby facilitate the assemblage, reduce the cost and enhance the reliability of the control of the capacity or delivery quantity and, further, a pressure-receiving area of at least one pressure-receiving protuberance can be increased without increase in sealing line length, to thereby enable a hysteresis of a control element to be restrained.

It is another object of the invention to provide a variable capacity vane compressor which can secure sufficient sealing performance even if variation occurs in dimension of various portions of a control element having sealing structure mounted thereon due to machining errors, to thereby make it possible to improve the capacity controllability of the compressor.

It is still another object of the invention to provide a variable capacity vane compressor in which resistance against angular movement of a control element can be reduced to improve the capacity controllability of the compressor, and when a sealing structure mounted on the control element is employed which comprises a resilient sealing member and an auxiliary sealing member having a smooth sliding surface and superposed upon the resilient sealing member, it is possible to facilitate the assembling of the auxiliary sealing member with the resilient sealing member.

It is a still further object of the invention to provide a variable capacity vane compressor in which a sealing structure can be conformed to a wall configuration of an annular recess formed in a side block, to thereby maintain sufficient air-tightness between the sealing structure and the annular recess.

According to the present invention, there is provided a variable capacity vane compressor comprising a cylinder formed by a cam ring and a pair of front and rear side blocks respectively closing opposite axial ends of the cam ring, one of the front and rear side blocks having at least one inlet port which has a first portion and a second portion; a rotor rotatably received within the cylinder, the one side block having an axial end face facing toward the rotor and an annular recess formed in the axial end face in substantially concentric relation to an axis of the one side block; a plurality of vanes radially slidably fitted in slits formed in the rotor; a low and a high pressure chamber; the cylinder, the rotor and the adjacent vanes cooperating with each other to defince a plurality of compression chambers which change in their respective volumes, as the rotor rotates, so that a compression medium is successively drawn into the compression chambers from the low pressure chamber through the first inlet port, and the drawn medium is compressed within the compression chambers and is discharged therefrom; the second portion of the at least one inlet port communicating with the low pressure chamber and with at least one of the compression chambers which is on a suction stroke; at least one space provided in the one side block and communicating with the low and high pressure chambers; at control element for controlling an opening degree of the at least one second inlet port, the control element including at least one pressure-receiving protuberance slidably fitted in the space to divide same into a first pressure chamber communicating with the low pressure chamber and a second pressure chamber communicating with the high pressure chamber and capable of communicating with the low pressure chamber, the pressure-receiving protuberance having formed therein a groove extending along an outer peripheral edge of the pressure-receiving protuberance, the control element having a central bore, an annular groove formed in a peripheral wall surface of the central bore, at least one generally radially extending groove formed in an axial end face of the control element, and at least one peripherally extending, arcuate groove formed in an outer peripheral surface of the control element; the control element angularly moving in response to a differential pressure between the first and second pressure chambers acting upon the pressure-receiving protuberance, for controlling the opening degree of the second inlet port, thereby controlling a compression commencing timing of the compressor to control a delivery quantity thereof; a communication passageway communicating the second pressure chamber and the low pressure chamber with each other; and valve means provided in the communication passageway for opening and closing same, the valve means being operable to close the communication passageway when the pressure within the low pressure chamber is above a predetermined value, and to open the communication passageway when the pressure within the low pressure chamber is below the predetermined value.

The variable capacity vane compressor according to the invention is characterized by including sealing means mounted on the control element for sealing between the first and second pressure chambers and between the low pressure chamber and a zone of a back pressure acting upon the vanes, the sealing means comprising a first annular sealing portion fitted in the annular groove formed in the peripheral wall surface of the central bore in the control element for sealing between the peripheral wall surface of the central bore and an inner peripheral side wall surface of the annular recess in the one side block, a second sealing portion cencentric with the first sealing portion and fitted in the arcuate groove formed in the outer peripheral surface of the control element for sealing between the outer peripheral surface of the control element and an outer peripheral side wall surface of the annular recess in the one side block, a third sealing portion provided in a manner integral with one end of the second sealing portion and the first sealing portion to connect them with each other, the third sealing portion being fitted in the groove extending along the outer peripheral edge of the pressure-receiving protuberance for sealing between the outer peripheral edge of the pressure-receiving protuberance and the inner and outer peripheral wall surfaces and a bottom wall surface of the annular recess in the one side block and an inner wall surface of the space, and a fourth sealing portion provided in a manner integral with the first sealing portion and the other end of the second sealing portion to connect them with each other, the fourth sealing portion being fitted in the groove formed in the axial end face of the control element for sealing between the axial end face of the control element and the bottom wall surface of the annular recess in the one side block.

The above and other objects, features and advantages of the invention will be more apparent from the ensuing detailed description taken in conjunction with the accompanying drawings.

Figure 6:
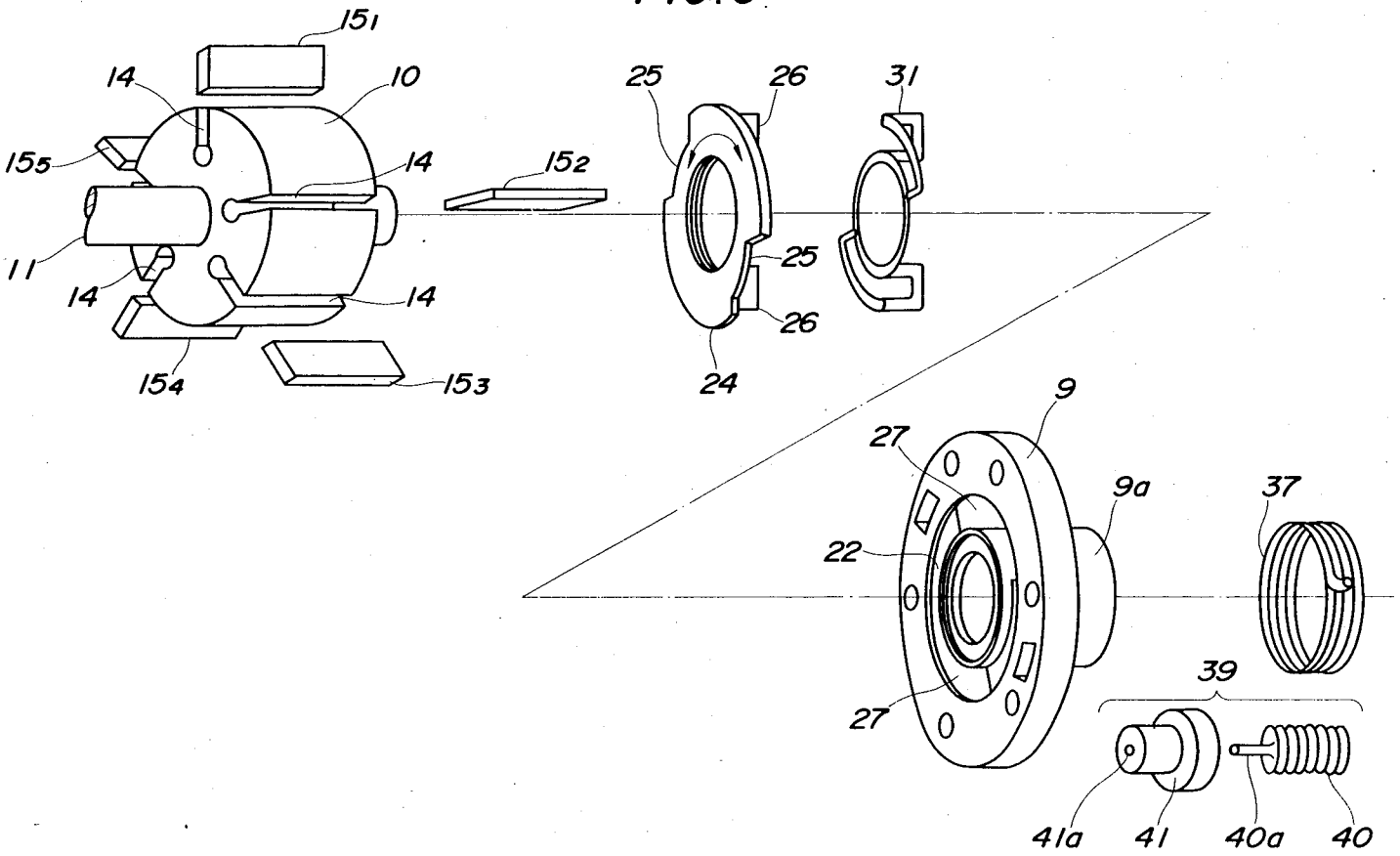
FIG. 6 is an exploded perspective view showing essential parts of the vane compressor of FIG. 2.
Figure 7:
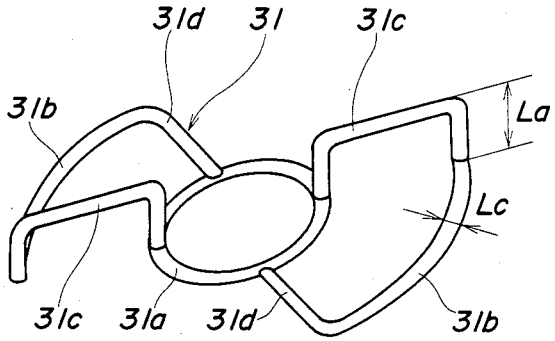
FIG. 7 is a perspective view of a sealing member and a control element according the first embodiment of the invention.
Figure 7:
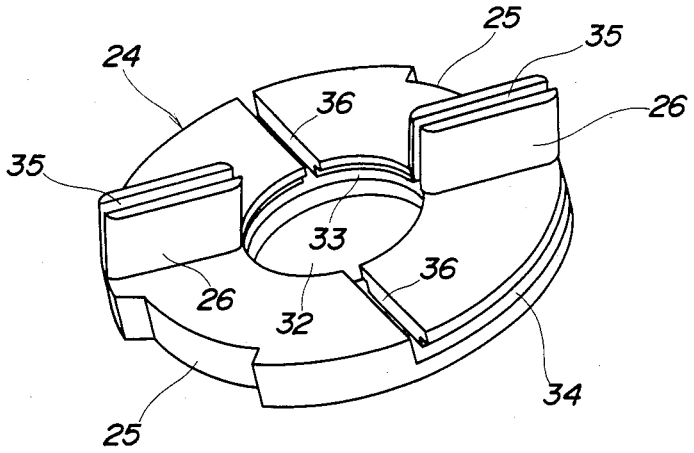
Figure 8:
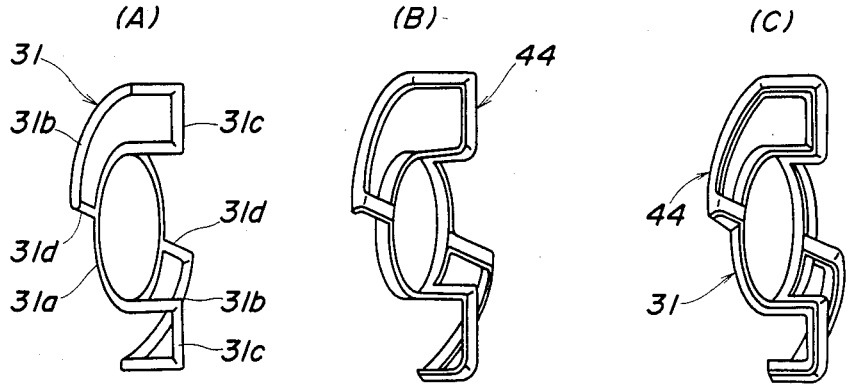
Figure 9:
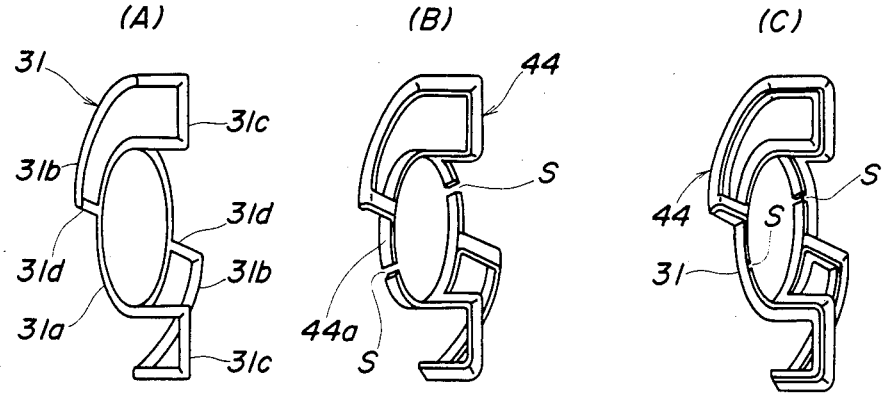
Figure 10:
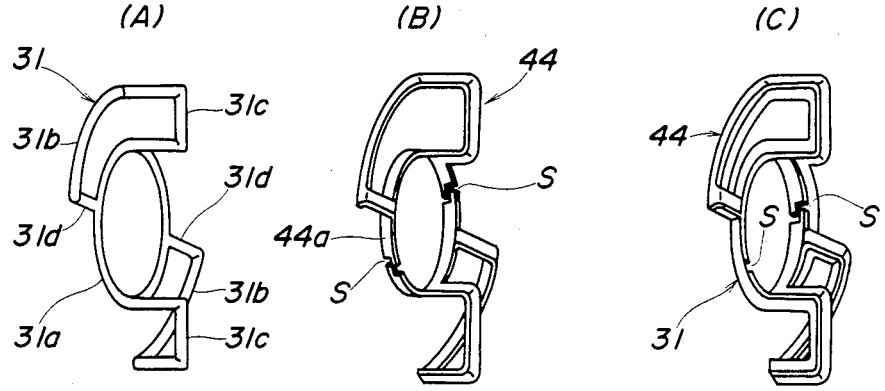
Figure 11:
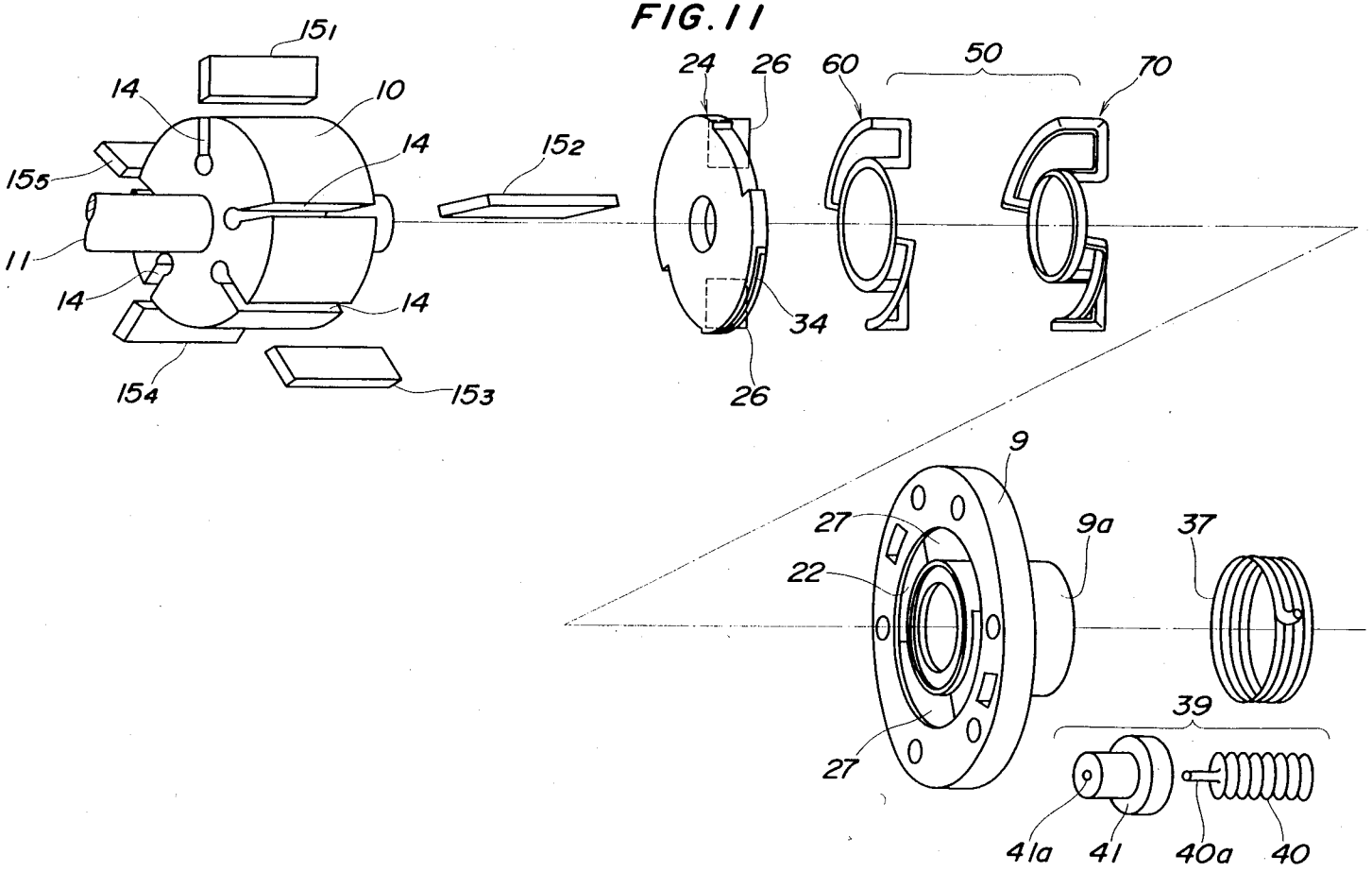
Figure 12:
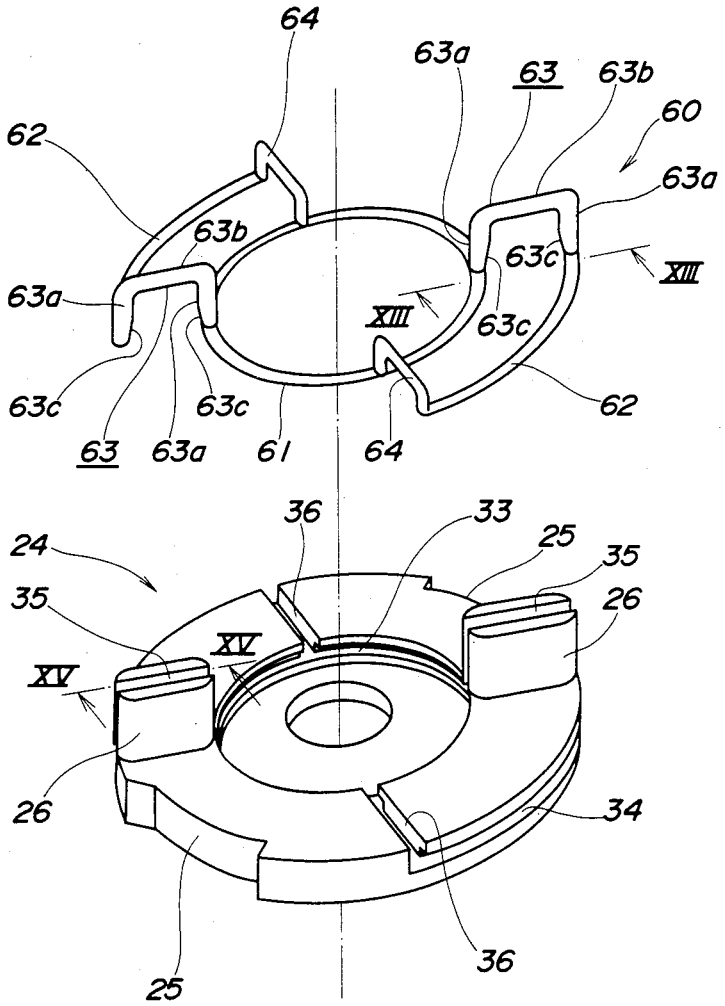
Figure 13:
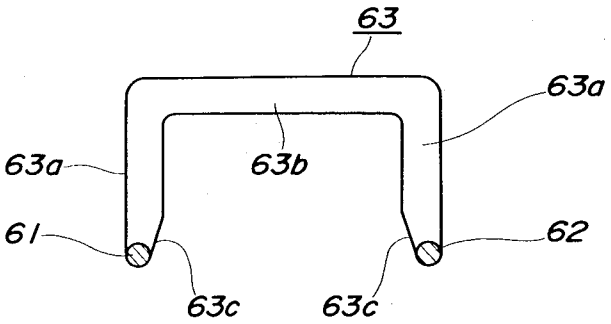
Figure 14:
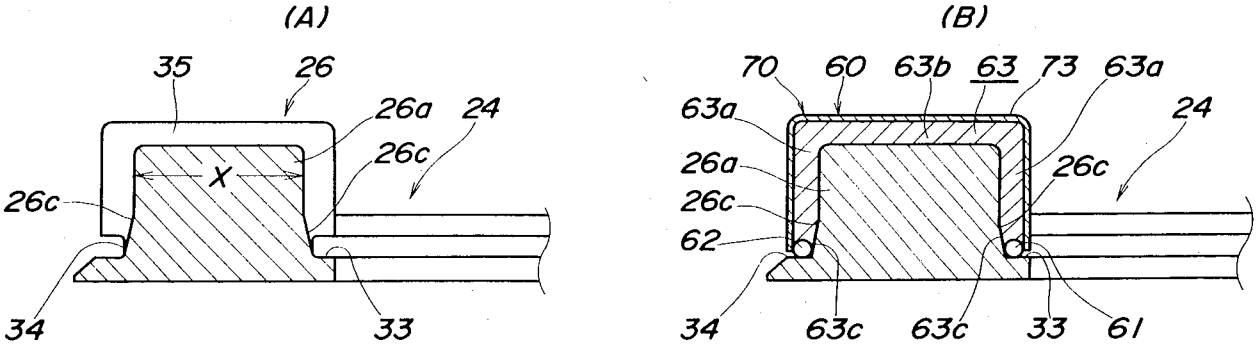
Figure 15:
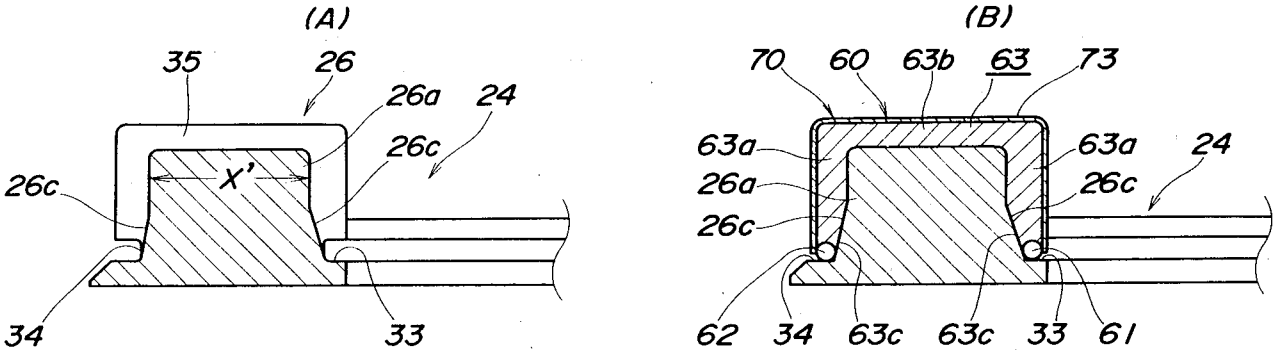
Figure 16:
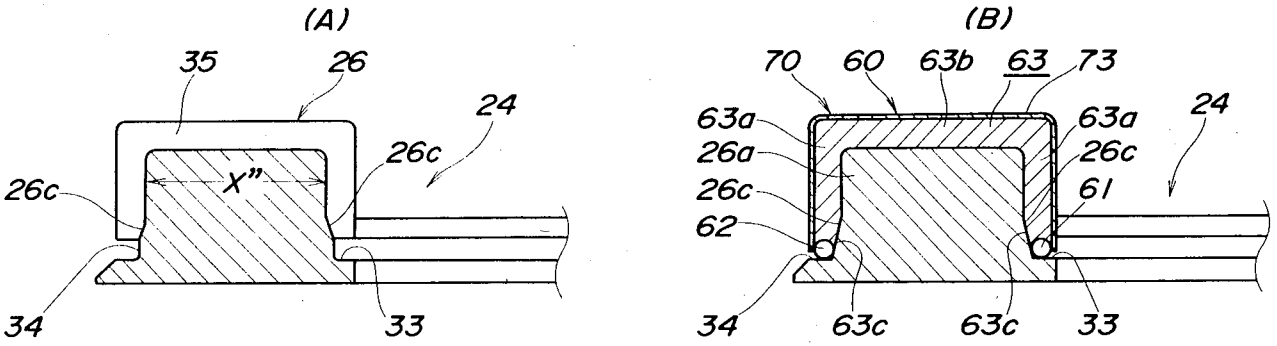
Figure 17:
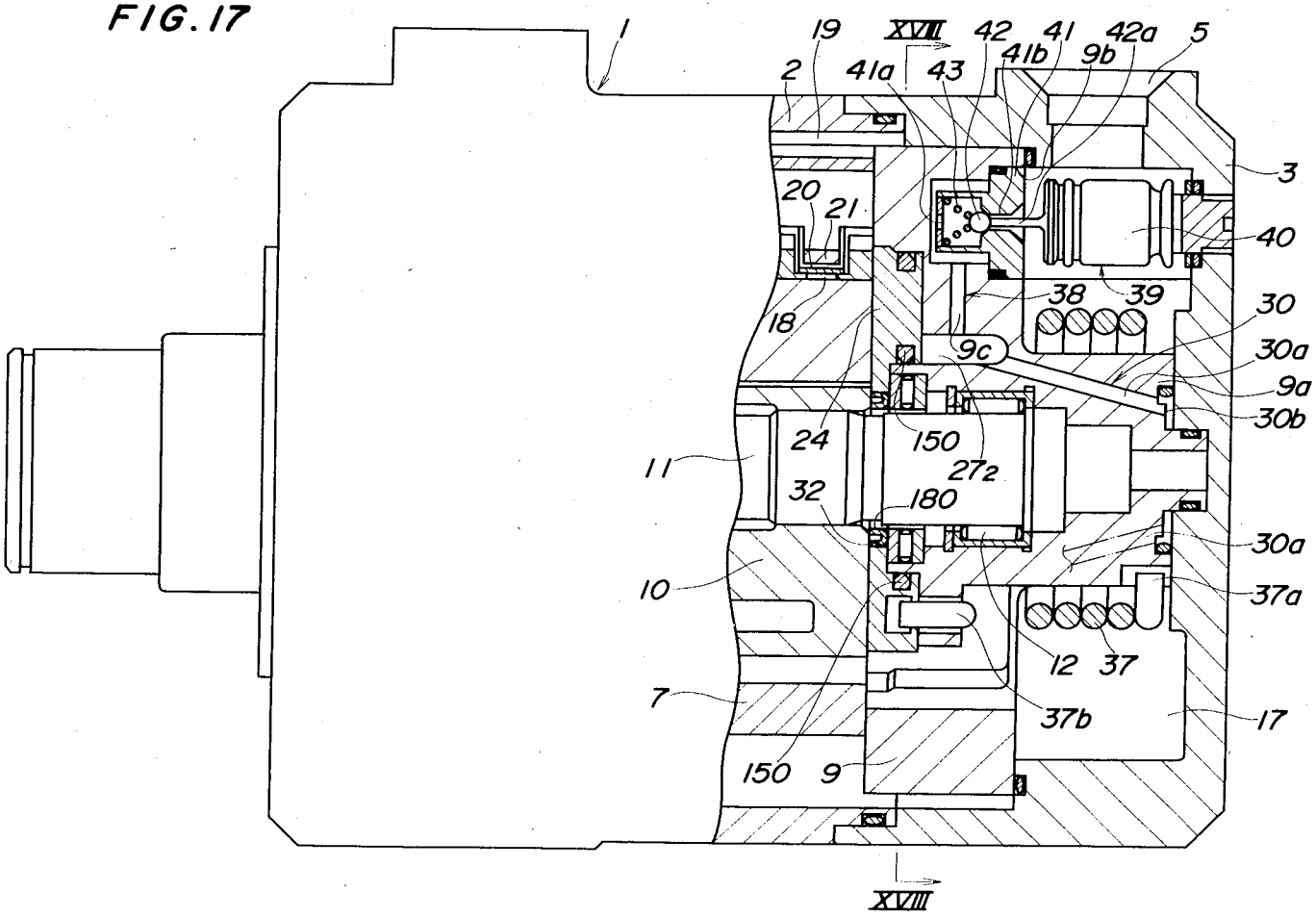
Figure 18:
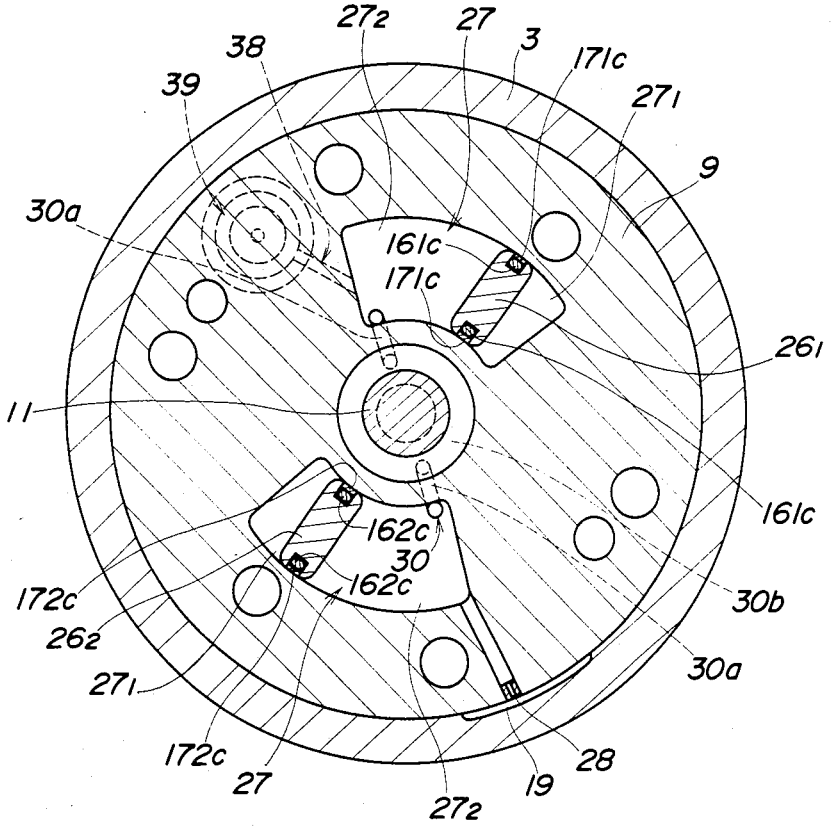
Figure 19:
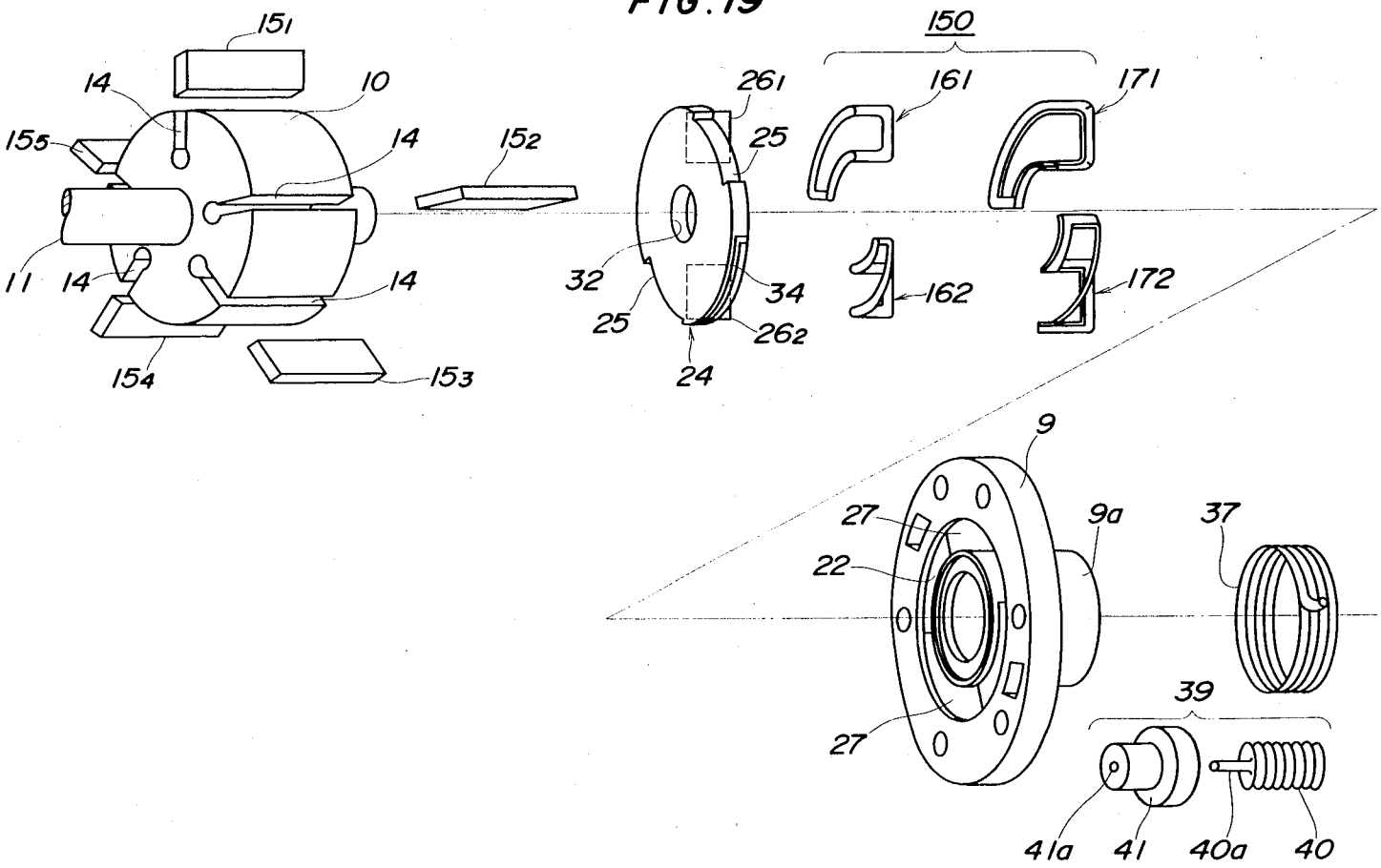
Figure 20:
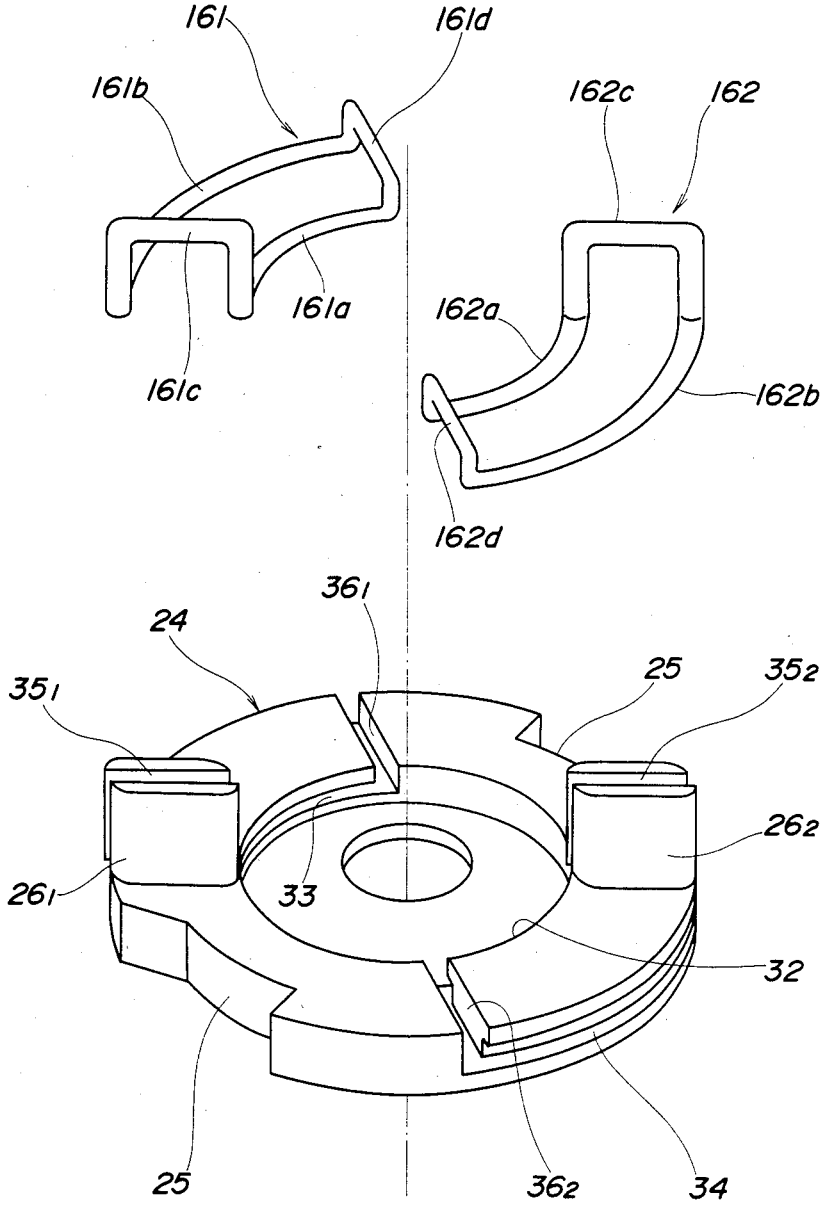
Figure 21:
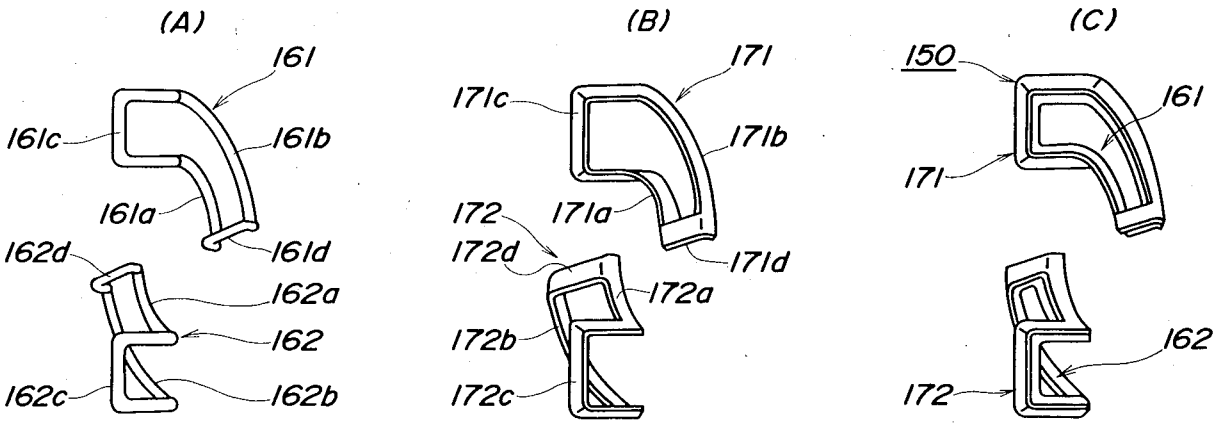
Figure 22:
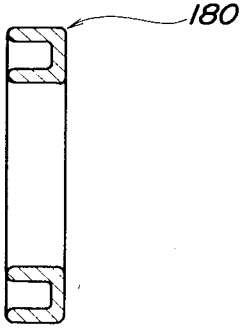
Figure 23:
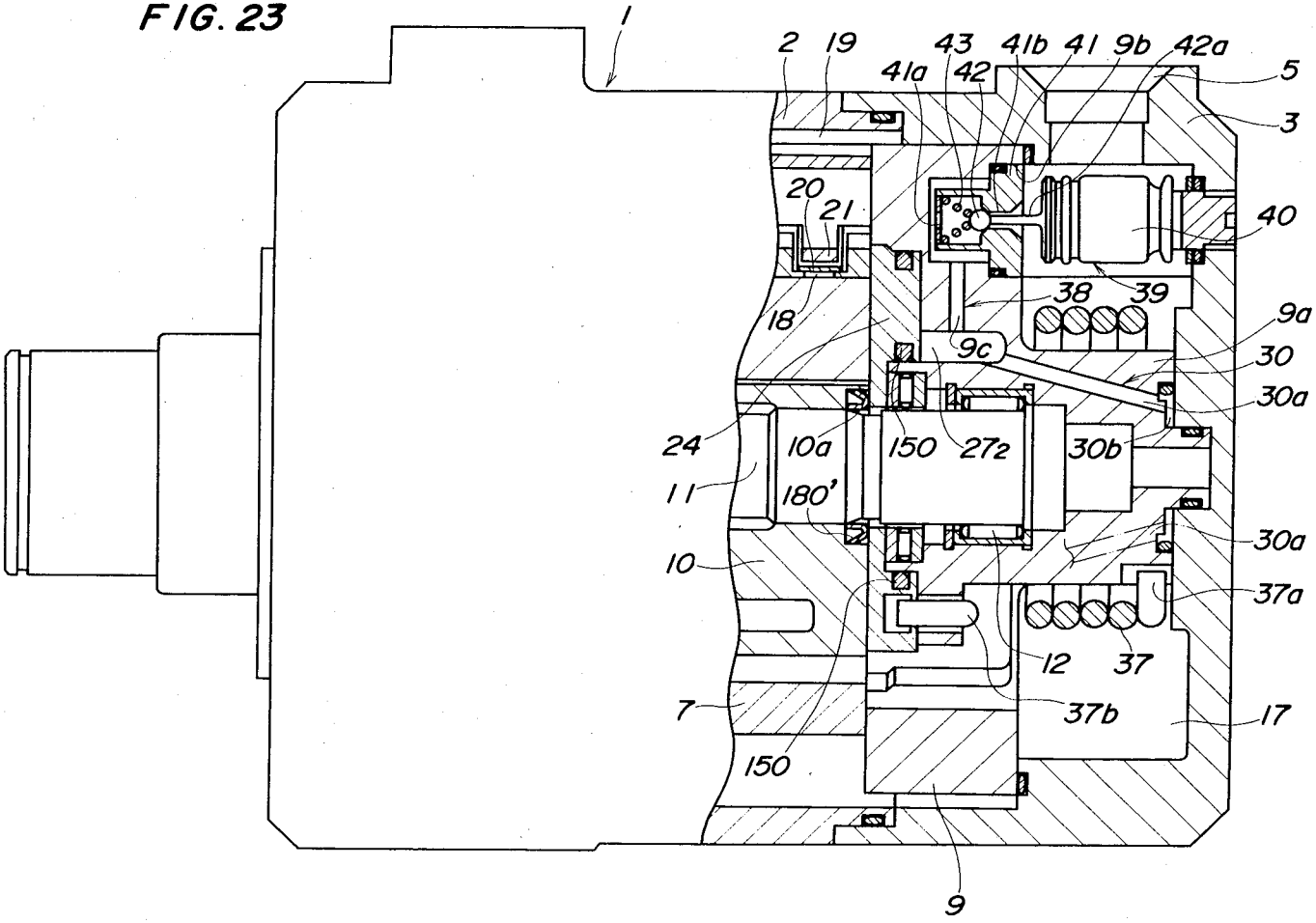
Figure 24:
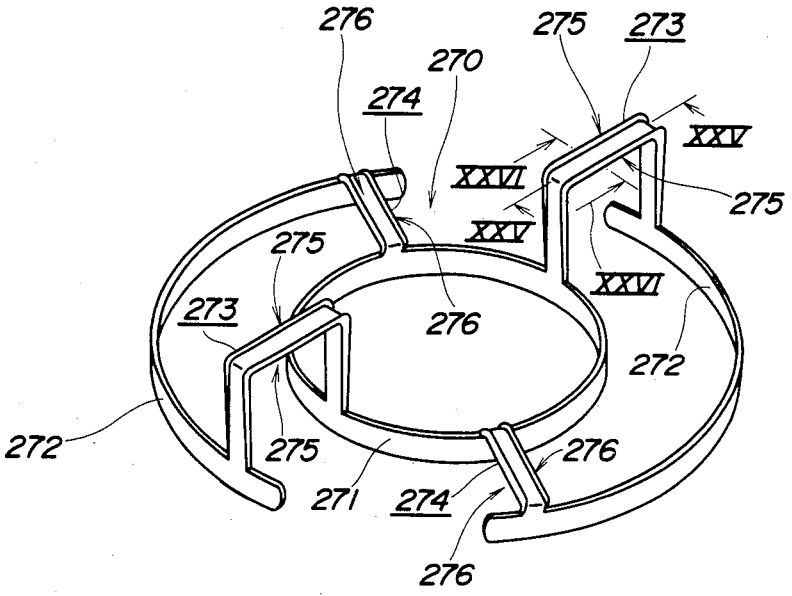
Figure 25:
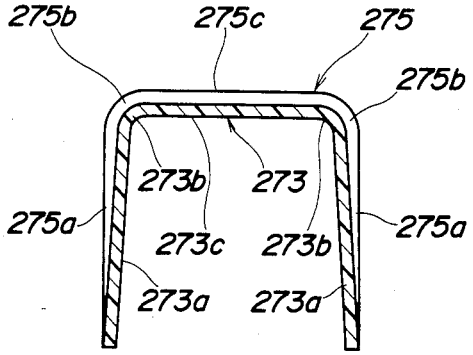
Figure 26:
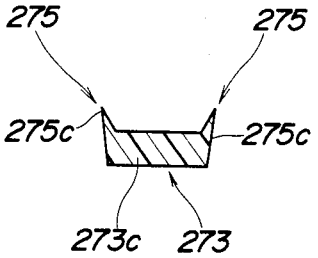
Figure 27:
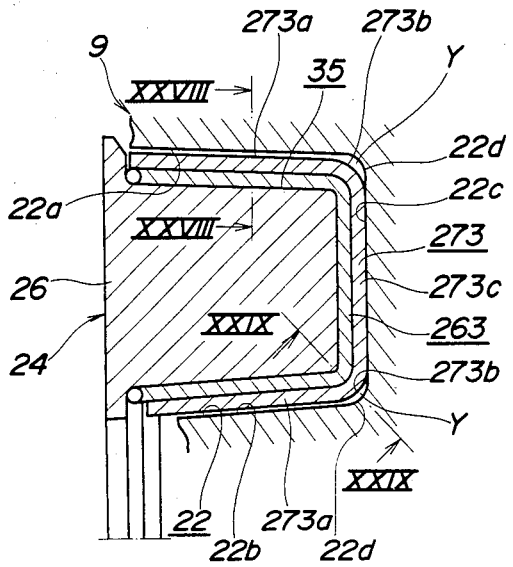
Figure 28:
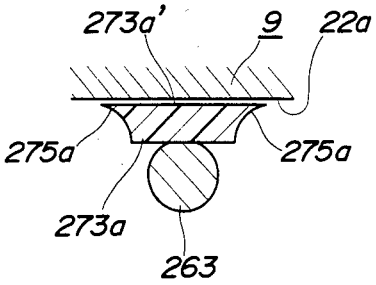
Figure 29:
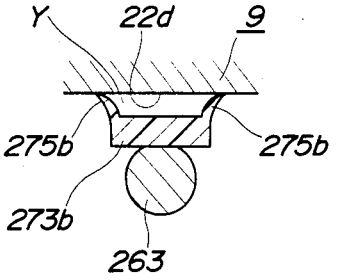
Figure 30:
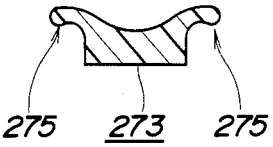
Figure 31:
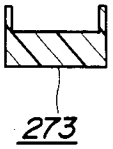
Figure 32:
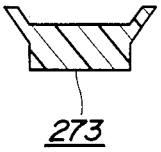

(A) of FIG. 8 is a perspective view of an elastic sealing member according to a second embodiment of the invention;

(B) of FIG. 8 is a perspective view of an auxiliary sealing member according to the second embodiment of the invention;

(C) of FIG. 8 is a perspective view showing the elastic sealing member coupled with the auxiliary sealing member;

(A), (B), and (C) of FIG. 9 are views similar to (A), (B), and (C) of FIG. 8, respectively, showing a variation of the second embodiment;

(A), (B), and (C) of FIG. 10 are views similar to (A), (B), and (C) of FIG. 8, respectively, showing another variation of the second embodiment;

FIG. 11 is a view similar to FIG. 6, showing a variable capacity vane compressor according to a third embodiment of the invention;

FIG. 12 is a view similar to FIG. 7, showing the third embodiment of the invention;

FIG. 13 is a transverse cross-sectional view taken along line XIII—XIII in FIG. 12;

(A) of FIG. 14 is a transverse cross-sectional view taken along line XIV—XIV in FIG. 12;

(B) of FIG. 14 shows the sealing member fitted on the control element in (A) of FIG. 14;

(A) and (B) of FIG. 15 are views similar to (A) and (B) of FIG. 14, respectively, wherein the width of a pressure-receiving protuberance is made smaller than a predetermined size X;

(A) and (B) of FIG. 16 are views similar to (A) and (B) of FIG. 14, respectively, wherein the width of the pressure-receiving protuberance is made larger than the predetermined size X;

FIG. 17 is a longitudinal cross-sectional view of a variable capacity vane compressor according to a fourth embodiment of the invention;

FIG. 18 is a transverse cross-sectional view taken along line XVIII—XVIII in FIG. 17;

FIG. 19 is a view similar to FIG. 6, showing the compressor of FIG. 17;

FIG. 20 is a view similar to FIG. 7, showing the fourth embodiment of the invention;

(A), (B), and (C) of FIG. 21 are views similar to (A), (B), and (C) of FIG. 8, respectively, showing the fourth embodiment;

FIG. 22 is a cross-sectional view of a lip seal according to the fourth embodiment;

FIG. 23 is a longitudinal cross-sectional view of a variable capacity vane compressor according to a fifth embodiment;

FIG. 24 is a perspective view of an auxiliary sealing member according to a sixth embodiment of the invention;

FIG. 25 is a cross-sectional view taken along line XXV—XXV in FIG. 24;

FIG. 26 is a cross-sectional view taken along line XXVI—XXVI in FIG. 24;

FIG. 27 is a cross sectional view showing the sealing member fitted on the pressure-receiving protuberance fitted in the recess of the rear side block;

FIG. 28 is a cross-sectional view taken along line XXVIII—XXVIII in FIG. 27;

FIG. 29 is a cross-sectional view taken along line XXIX—XXIX in FIG. 27;

FIG. 30 is a cross-sectional view showing a variation of the lip seal;

FIG. 31 is a view similar to FIG. 30, showing another variation of the lip seal; and FIG. 32 is view similar to FIG. 30, showing a further variation of the lip seal.

DETAILED DECRIPTION

The invention will now be described in detail with reference to the drawings showing embodiments thereof.

FIGS. 2 through 7 show a variable capacity vane compressor according to a first embodiment of the invention. A housing 1 comprises a cylindrical casing 2 with an open end, and a rear head 3, which is fastened to the casing 2 by means of bolts, not shown, in a manner closing the open end of the casing 2. A discharge port 4, through which a refrigerant gas is to be discharged as a thermal medium, is formed in an upper wall of the casing 2 at a front end thereof, and a suction port 5, through which the refrigerant gas is to be drawn into the compressor, is formed in an upper portion of the rear head 3. The discharge port 4 and the suction port 5 communicate, respectively, with a discharge pressure chamber and a suction chamber, both hereinafter referred to.

A pump body 6 is housed in the housing 1. The pump body 6 is composed mainly of a cylinder formed by a cam ring 7, and a front side block 8 and a rear side block 9 closing open opposite ends of the cam ring 7, a cylindrical rotor 10 rotatably received within the cam ring 7, and a driving shaft 11 which is connected to an engine, not shown, of a vehicle or the like, and on which is secured the rotor 10. The driving shaft 11 is rotatably supported by a pair of radial bearings 12 provided in the side blocks 8 and 9, respectively. The driving shaft 11 extends through the front side block 8 and the front head 3 while being sealed in an airtight manner against the interior of the compressor by means of a mechanical sealing device 46 provided around the shaft 11 in the front head 3.

Figure 3:
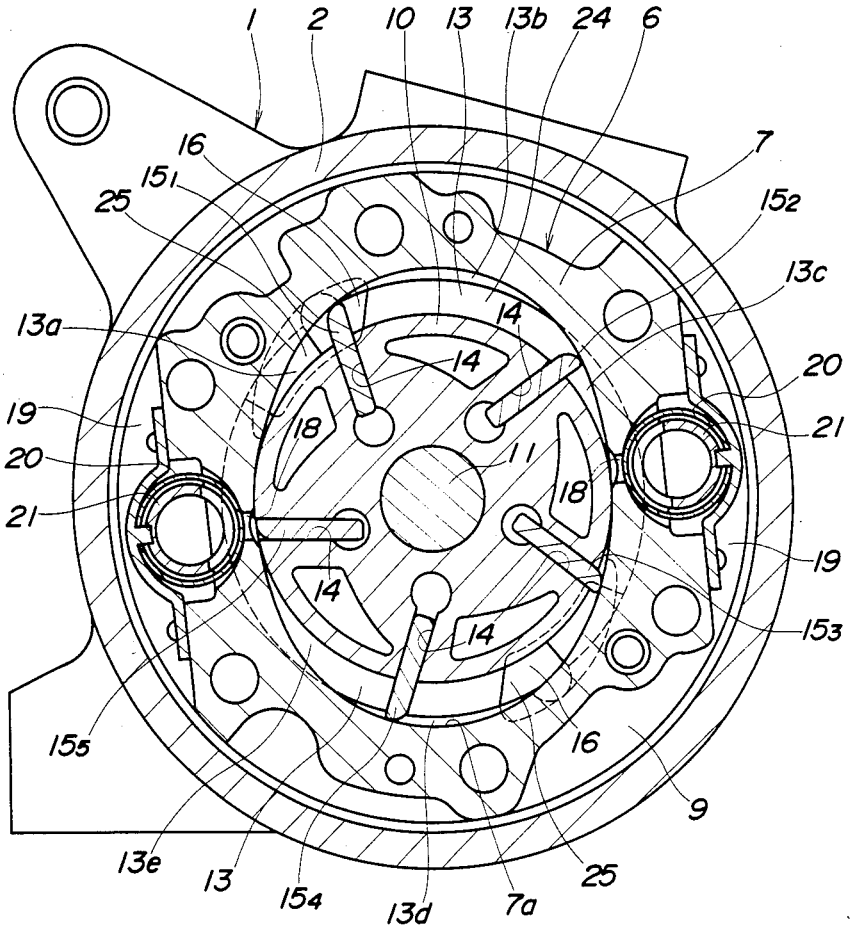
FIG. 3 is a transverse cross-sectional view taken along line III—III in FIG. 2.

The cam ring 7 has an inner peripheral surface 7*a* with an elliptical cross section, as shown in FIG. 3, and cooperates with the rotor 10 to define therebetween a pair of spaces 13 and 13 at diametrically opposite locations.

The rotor 10 has its outer peripheral surface formed with a plurality of (five in the illustrated embodiment) axial vane slits 14 at circumferentially equal intervals, in each of which a vane $15_1$–$15_5$ is radially slidably fitted. Adjacent vanes $15_1$–$15_5$ define therebetween five compression chambers 13*a*–13*e* in cooperation with the cam ring 7, the rotor 10, and the opposite inner end faces of the front and rear side blocks 8, 9.

Figure 4:
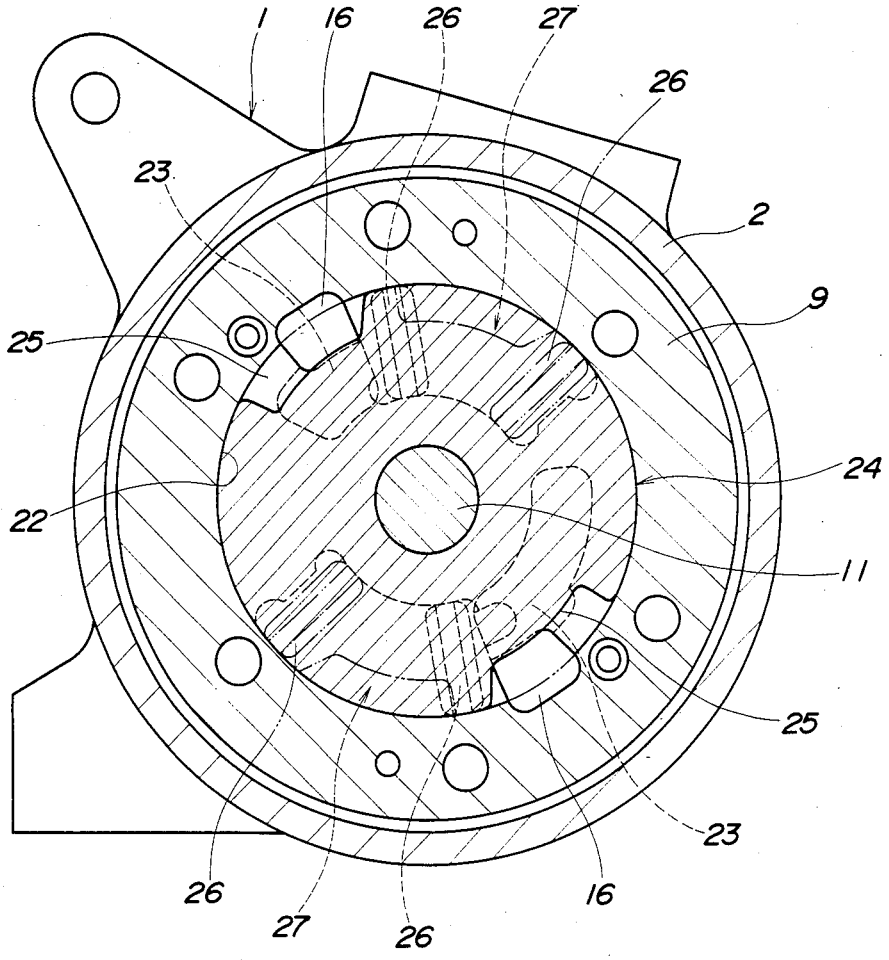
FIG. 4 is a transverse cross-sectional view taken along line IV—IV in FIG. 2.

Refrigerant inlet ports 16 and 16 are formed in the rear side block 9 at diametrically opposite locations as shown in FIGS. 3 and 4. These refrigerant inlet ports 16, 16 are located at such locations that they become closed when the respective compression chambers 13*a*–13*e* assume the maximum volume. These refrigerant inlet ports 16, 16 axially extend through the rear side block 9 and through which a suction chamber (lower pressure chamber) 17 defined in the rear head 3 by the rear side block 9 and the space 13 or compression chamber 13*a*, 13*d* on the suction stroke are communicated with each other.

Figure 1:
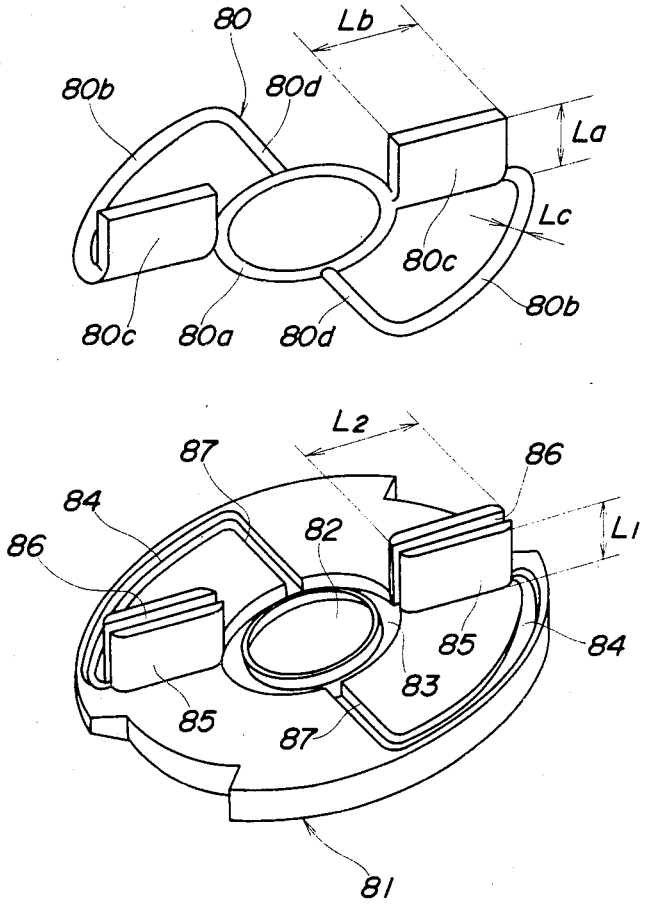
FIG. 1 PRIOR ART
FIG. 1 is a perspective view of conventional sealing member and control element.
Figure 2:
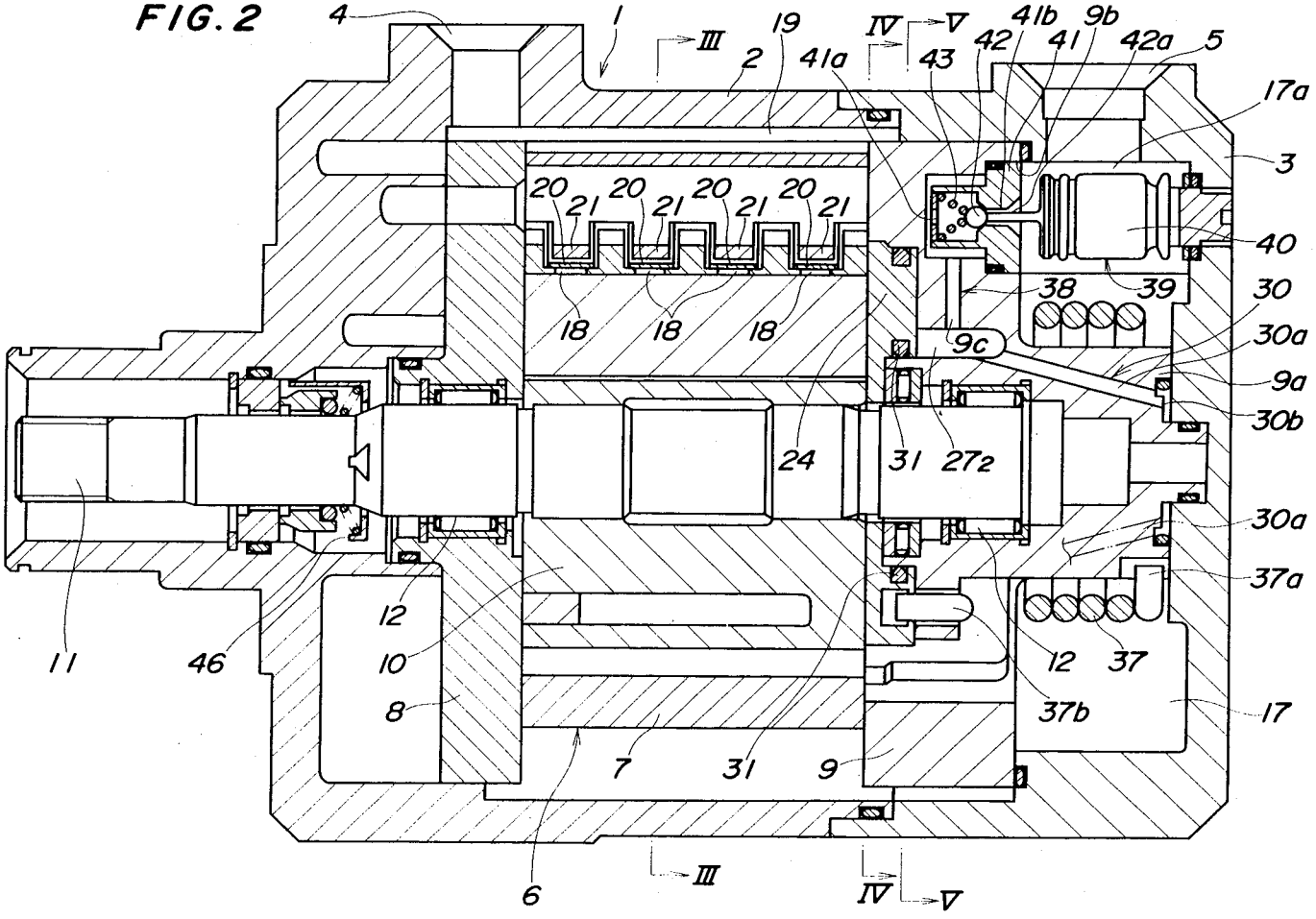
FIG. 2 is a longitudinal cross-sectional view of a variable capacity vane compressor according to a first embodiment of the present invention.

Refrigerant outlet ports 18 are formed through opposite lateral side walls of the cam ring 7 and through which spaces 13 or compression chambers 13*c* and 13*e* on the discharge stroke are communicated with the discharge pressure chamber (higher pressure chamber) 19 defined within the casing 2, as shown in FIGS. 2 and 3. These refrigerant outlet ports 18 are provided with respective discharge valves 20 and valve retainers 21, as shown in FIG. 3.

Figure 5:
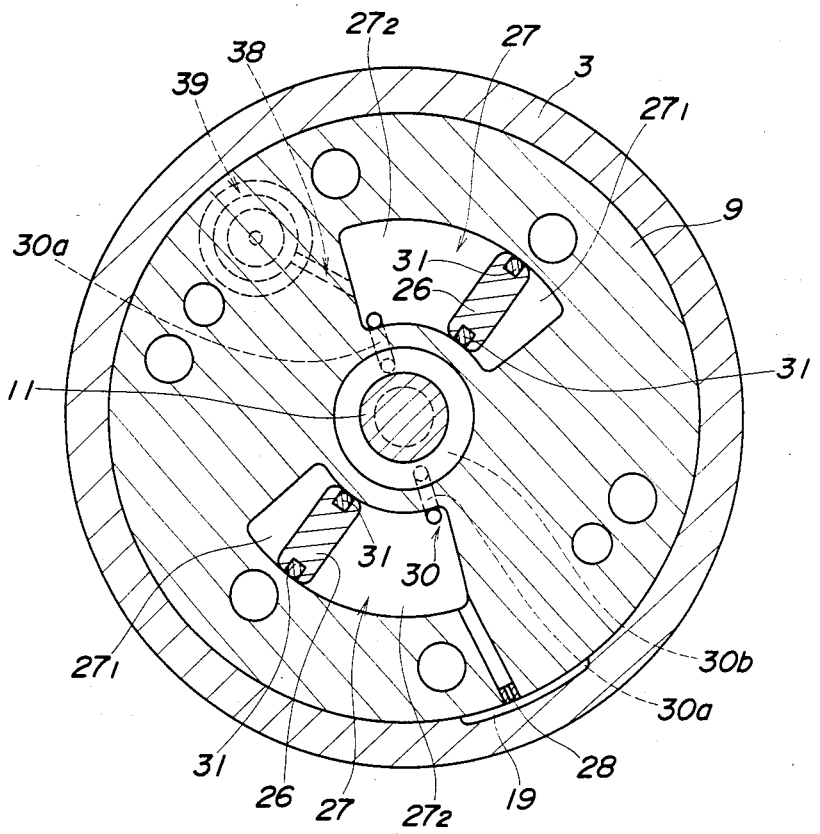
FIG. 5 is a transverse cross-sectional view taken along line V—V in FIG. 2.

The rear side block 9 has an end face facing the rotor 10, in which is formed an annular recess 22 larger in diameter than the rotor 10, as shown in FIGS. 4 and 6. Due to the presence of the annular recess 22, no part of the end face of the rotor 10 facing the rear side block 9 is in contact with the opposed end face of the latter. A pair of second inlet ports 23 and 23 in the form of arcuate openings are formed in the rear side block 9 at diametrically opposite locations and circumferentially extend continuously with the annular recess 22 along its outer periphery, as best shown in FIG. 4, and through which the suction chamber 17 is communicated with the compression chamber 13*a*, 13*d* on the suction stroke. An annular control element 24 is received in the annular recess 22 for rotation in opposite circumferential directions to control the opening angle of the second inlet ports 23, 23. The control element 24 has its outer peripheral edge formed with a pair of diametrically opposite arcuate cut-out portions 25 and 25, and its one side surface formed integrally with a pair of diametrically opposite pressure-receiving protuberances 26 and 26 axially projected therefrom and acting as pressure-receiving elements. The pressure-receiving protuberances 26, 26 are slidably received in respective arcuate spaces 27 and 27 which are formed in the rear side block 9 in a manner continuous with the annular recess 22 and circumferentially partially overlapping with the respective second inlet ports 23, 23. As shown in FIG. 5, the interior of each of the arcuate spaces 27, 27 is divided into first and second pressure chambers $27_1$ and $27_2$ by the associated pressure-receiving protuberance 26. The first pressure chamber $27_1$ communicates with the suction chamber 17 through the corresponding inlet port 16 and the corresponding second inlet port 23, and the second pressure chamber $27_2$ communicates with the discharge pressure chamber 19 through a restriction passage 28 formed in the rear side block 9, as shown in FIG. 5. The two chambers $27_2$, $27_2$ are communicated with each other by way of a communication passage 30 formed in the control element 24. The communication channels 30 comprises a pair of communication channels 30*a*, 30*a* formed in a boss 9*a* projected from a central portion of the rear side block 9 at a side remote from the rotor 10, and an annual space 30*b* defined between a projected end face of the boss 9*a* and an inner end face of the rear head 3, as shown in FIGS. 2 and 5. The communication channels 30*a*, 30*a* are arranged symmetrically with respect to the center of the boss 9*a*. Respective ends of the communication channels 30*a*, 30*a* are communicated with the respective second pressure chambers $27_2$, $27_2$, and the other respective ends are communicated with the annual space 30*b*.

Since the communication passage 30 is provided in the rear side block 9 as a stationary member, as decribed above, the operation of boring the passage 30 is easier to perform as compared with an arrangement that the communication passage 30 is provided in the control element 24 as a rotatable member. Moreover, since the communication channels 30*a*, 30*a* each have its both ends opening into the corresponding spaces $27_2$, 30*b*, it is positively remove foreign matters such as chips produced by the boring operation, whereby the compressor can be operated with high reliability. That is, if the communication passage 30 is formed in the control element 24, it is necessary to form in the control element two oblique holes crossing with each other and fit blank pins into respective open ends of the oblique holes, which makes it difficult to remove the boring chips.

A sealing member 31 of a special configuration, formed of an elastic rubber member, is mounted in the control element 24, and has four sealing portions 31*a*, 31*b*, 31*c*, and 31*d*, as shown in FIG. 7. A first annular sealing portion 31*a* is disposed in an annular groove 33 formed in a peripheral wall surface of a central bore 32 formed in the control element 24, to seal between the peripheral wall surface of the central bore 32 and an inner peripheral side wall surface of the annular recess 22 of the rear side block 9. A pair of second arcuate sealing portions 31*b*, each formed concentrically with respect to the first sealing portion 31*a*, are disposed respectively in a pair of grooves 34 formed in an outer peripheral surface of the control element 24 at circumferentially symmetrical positions with each other, to seal between the outer peripheral surface of the control element 24 and an outer peripheral side wall surface of the annular recess 22. A pair of third sealing portions 31*c*, which connect respective ends of the second sealing portions 31*b* with the first sealing portion 31*a*, are disposed respectively in a pair of grooves 35 extending along respective outer peripheral edges of the pressure-receiving protuberances 26, each to seal between the outer peripheral edge of the protuberance 26 and the inner and outer peripheral wall surfaces and a bottom wall surface of the annular recess 22 of the rear side block 9. A pair of fourth sealing portions 31*d* which connect the other respective ends of the second sealing portions 31*b* with the first sealing portion 31*a*, are disposed respectively in a pair of radial linear grooves 36 formed in an axial end face of the control element 24, to seal between the axial end face of the control element 24 and the bottom wall surface of the annular recess 22 of the rear side block 9.

Thus, the sealing member 31 seals in an airtight manner between the first and second pressure chambers $27_1$ and $27_2$, as shown in FIG. 5, as well as between the inner and outer peripheral surfaces of the control element 24 and the annular recess 22 of the rear side block 9, as shown in FIG. 6.

The control element 24 is elastically urged in such a circumferential direction as to increase the opening angle of the second inlet ports 23, i.e. in the counterclockwise direction as viewed in FIG. 4, by a coiled spring 37 fitted around a central boss 9*a* of the front side block 9 axially extending toward the suction chamber 17, with its one end engaged by the central boss 9*a* and the other end by the control element 24, respectively.

The second pressure chamber $27_2$ is communicated with the suction chamber 17 by way of a communication passage 38 formed in the rear side block 9, as shown in FIGS. 2 and 5. Arranged across the communication passage 38 is a control valve device 39 for selectively closing and opening the communication passage 38, as shown in FIG. 2. The control valve device 39 is operable in response to pressure within the suction chamber 17, and as shown in FIG. 2 it comprises a flexible bellows 40 disposed in the suction chamber 17, with its axis extending parallel with that of the driving shaft 11, a valve casing 41 arranged in a recess 17*a* continuous with the suction chamber 17, a ball valve body 42, and a coiled spring 43 urging the ball valve body 42 in its closing direction. The valve casing 41 is fitted in a bore 9*b* formed in the rear side block 9 at a side remote from the rotor 10, and is opposed to the bellows 40. The communication passage 38 is formed of communication holes 41*a*, 41*b* formed in opposite end walls of the valve casing 41 and a hollow interior of the valve casing 41, as well as of a communication hole 9*c* formed in the rear side block 9. The ball valve body 42 arranged in the valve casing 41 is disposed to close and open the communication hole 41*b* formed in an end wall close to the bellows 40. The coiled spring 43 is interposed between the ball valve body 42 and an inner surface of the other end wall of the valve casing 41. When the suction pressure within the suction chamber 17 is above a predetermined value, the bellows 34 is in a contracted state so that the ball valve body is biased to close the communication hole 41*b* by the force of the spring 43. When the suction pressure is below the predetermined value, the bellows 34 is in an expanded state to urgingly bias the ball valve body 42 to open the communication hole 41*b* against the force of the spring 43 through a rod 42*a* loosely fitted through the communication hole 41*b*.

The operation of the first embodiment of the invention will now be explained.

As the driving shaft 11 is rotatively driven by a prime mover such as an automotive engine to cause clockwise rotation of the rotor 10 as viewed in FIG. 3, the rotor 10 rotates so that the vanes $15_1$–$15_5$ successively move radially out of the respective slits 14 due to a centrifugal force and back pressure acting upon the vanes and revolve together with the rotating rotor 10, with their tips in sliding contact with the inner peripheral surface of the cam ring 7. During the suction stroke the compression chamber 13*a*, 13*d* defined by adjacent vanes increases in volume so that refrigerant gas as thermal medium is drawn through the refrigerant inlet port 16 into the compression chamber 13*a*, 13*d*; during the following compression stroke the compression chamber 13*c*, 13*e* decreases in volume to cause the drawn refrigerant gas to be compressed; and during the discharge stroke at the end of the compression stroke the high pressure of the compressed gas forces the discharge valve 20 to open to allow the compressed refrigerant gas to be discharged through the refrigerant outlet port 18 into the discharge pressure chamber 19 and then discharged through the discharge port 4 into a heat exchange circuit of an associated air conditioning system, not shown.

During the operation of the compressor described above, low pressure or suction pressure within the suction chamber 17 is introduced into the first pressure chamber $27_1$ of each space 27 through the refrigerant inlet port 16, whereas high pressure or discharge pressure within the discharge pressure chamber 19 is introduced into the second pressure chamber $27_2$ of each space 27 through the restriction passage 28 or through both the restriction passage 28 and the communication passage 30. The control element 24 is circumferentially displaced depending upon the difference between the sum of the pressure within the first pressure chamber $27_1$ and the biasing force of the coiled spring 37 (which acts upon the control element 24 in the direction of the opening angle of each second inlet port 23 being increased, i.e. in the counter-clockwise direction as viewed in FIG. 4) and the pressure within the second pressure chamber $27_2$ (which acts upon the control element 24 in the direction in which the above opening angle is decreased, i.e. in the clockwise direction as viewed in FIG. 4), to vary the opening angle of each second inlet port 23 and accordingly vary the timing of commencement of the compression stroke and hence the delivery quantity. When the above difference becomes zero, that is, when the sum of the pressure within the first pressure chamber $27_1$ and the biasing force of the spring 32 becomes balanced with the pressure within the second pressure chamber $27_2$, the circumferential displacement of the control element 24 stops.

For instance, when the compressor is operating at a low speed, the refrigerant gas pressure or suction pressure within the suction chamber 17 is so high that the bellows 40 of the control valve device 39 is contracted to bias the ball valve body 42 to close the communication passage 38, as shown in FIG. 2. Accordingly, the pressure within the discharge pressure chamber 19 is introduced into the second pressure chamber $27_2$. Thus, the pressure within the second pressure chamber $27_2$ surpasses the sum of the pressure within the first pressure chamber $27_1$ and the biasing force of the coiled spring 37 so that the control element 24 is circumferentially displaced into an extreme position in the clockwise direction as viewed in FIG. 4, whereby the second inlet ports 23, 23 are fully closed by the control element 24 as indicated by the two-dot chain lines in FIG. 4 (the opening angle is zero). Consequently, all the refrigerant gas drawn through the refrigerant inlet port 16 into the compression chamber 13*a*, 13*d* on the suction stroke is compressed and discharged, resulting in the maximum delivery quantity (Full Capacity Operation).

On the other hand, when the compressor is brought into high speed operation, the suction pressure within the suction chamber 17 is so low that the bellows 40 of the control valve 39 is expanded to urgingly bias the ball valve body 42 against the urging force of the spring 43 to open the communication passage 38. Accordingly, the pressure within the second pressure chamber $27_2$ leaks through the communication passage 38 (i.e. communication holes 9*c*, 41*a*, and 41*b*) into the suction chamber 17 in which low or suction pressure prevails to cause a prompt drop in the pressure within the second pressure chamber $27_2$. As a result, the control element 24 is promptly angularly or circumferentially displaced in the counter-clockwise direction as viewed in FIG. 4. When the cut-out portions 25, 25 of the control element 24 thus become aligned with the respective second inlet ports 23, 23 to open the latter, as indicated by the solid lines in FIG. 4, refrigerant gas in the suction chamber 17 is drawn into the compression chambers 13*a*, 13*d* not only through the refrigerant inlet ports 16, 16 but also through the second inlet ports 23, 23. Therefore, the timing of commencement of the compression stroke is retarded by an amount corresponding to the degree of opening of the second inlet ports 23, 23 so that the compression stroke period is reduced, resulting in a reduced amount of refrigerant gas that is compressed and hence a reduced delivery quantity (Partial Capacity Operation).

Incidentally, the opening angle of the second inlet ports 23, 23 is controlled to a value where the sum of the pressure force within the first pressure chamber $27_1$ and the force of the coiled spring 31 balances with the pressure force within the second pressure chamber $27_2$. The circumferential position of the control element 24 varies in a continuous manner in response to change in the suction pressure within the suction chamber 17. Thus, the delivery quantity or capacity of the compressor is controlled to vary in a continuous manner.

Although in the embodiment the second pressure chamber $27_2$ is supplied with discharge gas pressure from the discharge pressure chamber 19, back pressure acting upon the vanes $15_1$–$15_5$ to urge them in the radially outward direction may be supplied to the second pressure chamber $27_2$, instead of the discharge gas pressure.

Further, although in the embodiment the refrigerant inlet port 16 and the second inlet port 23 are discrete with each other, alternatively a single arcuate elongate inlet port may be formed, which has a first portion corresponding to the inlet port 16 and a second portion continuous with the first portion and corresponding to the second inlet port 23.

According to the first embodiment of the invention, since the sealing member 31 is arranged on the axial one end face and inner and outer peripheral surfaces of the control element 24, as shown in FIG. 7, it is possible to increase the pressure-receiving area of each pressure-receiving protuberance 26 with respect to the sealing line length, by an amount corresponding to sections of the respective first and second sealing portions 31*a* and 31*b*, which are received respectively in the grooves 33 and 34 formed in the respective inner and outer peripheral surfaces of the control element 24. That is, it is possible to increase the press-receiving areas of the respective pressure-receiving protuberances 26 without increase in the seal resistance. Accordingly, the hysteresis can be restrained so that the controllability is enhanced. Moreover, since it suffices that only the diameter Lc (cf. FIG. 7) is controlled in order to control the dimension of the sealing member 31, the manufacturing accuracy is relieved. Furthermore, when the control element 24 is displaced axially by the action of the pressure, all of the first to fourth sealing portions of the sealing member 30 do not undergo variation in pressure unlike the aforementioned utility model application, but only the pressure acting upon the third and foruth sealing portions varies. Thus, higher air-tightness and more stable slidability are achieved as compared with the sealing member of the utility model application.

A second embodiment of the invention will next be described with reference to FIGS. 8(A) through 8(C), in which like reference numerals are used to designate component parts like or similar to those of the above-mentioned first embodiment shown in FIGS. 1 through 7, and the description of the like or similar component parts will therefore be omitted. A sealing structure employed in the second embodiment is so constructed as to comprise the sealing member 31 shown in FIG. 8(A), and an auxiliary sealing member 44 in the form of a sheet shown in FIG. 8(B), which is superposed upon the sealin member 31 as shown in FIG. 8(C), to reduce the sliding resistance thereof. The auxiliary sealing member 44 has its configuration substantially identical with that of the sealing member 31 and is formed of a material having lower coefficent of friction, such as fluorocarbon resin, preferably Teflon (Trademark by Du Pont Corporation). Thus, the entire surface portion of the sealing member 31 which is in sliding contact with adjacent component parts is covered with the auxiliary sealing member 44, so that the sliding resistance is extremely reduced to enable smooth rotation of the control element 24, making it possible to perform the capacity control of the compressor in a more precise manner. In case where, in order to reduce the sliding resistance of the sealing member formed of an elastic rubber, the auxiliary sealing member 44 formed of Teflon having the same configuration as the sealing member is superposed thereupon, such a problem might arise for the arrangement of the aforementioned utility model application illustrated in FIG. 1, that since the sealing member 80 is disposed only on the axial one end face of the control element 81, the auxiliary sealing member is separated from the sealing member 80 at the third sealing portions 80*c*, because the auxiliary sealing member formed of Teflon does not contract when the third sealing portions 80*c* contract to have its height dimension La reduced. On the other hand, with the arrangement of the first embodiment of the invention in which the sealing member 31 is mounted on the control element 24 in a manner extending over the axial one end face and inner and outer peripheral surfaces of the control element 24, the first and second sealing portions 31*a* and 31*b* of the sealing member 31 can slightly move or escape axially of the control element 24, within the respective grooves 33 and 34 formed in the respective inner and outer peripheral surfaces of the control element 24, when the third sealing portions 31*c* contract to have its height dimension La reduced. Thus, it is made possible to avoid the separation of the auxiliary sealing member 44 formed of Teflon, from the sealing member 31.

FIGS. 9(A) through 9(C) show a variation of the embodiment illustrated in FIG. 8. The variation comprises the auxiliary sealing member 44 which is divided into two pieces at an annular portion 44*a* to provide respective slight linear gaps S between opposed ends of the divided two pieces, in order to make it possible to effect the above-mentioned escape in a smoother manner.

FIGS. 10(A) through 10(C) show another variation of the embodiment illustrated in FIG. 8. This variation is identical with the above-mentioned variation illustrated in FIG. 9 in that the auxiliary sealing member 44 is divided into two pieces at the annular portion 44*a*. In the variation, however, the respective gaps between the opposed ends of the divided two pieces are not merely severed linearly as is in the variation illustrated in FIG. 9, but are cut out in the form of a generally L-shape, and the divided two pieces are engaged with each other at the L-shaped cut-outs.

Other feature, arrangement and function of the variations illustrated in FIGS. 9 and 10 are substantially the same as those of the embodiment illustrated in FIG. 8. Accordingly, in FIGS. 9 and 10, like reference numerals are used to designate component parts like or similar to those illustrated in FIG. 8, and the description of such like or similar component part is therefore omitted.

Although the variations illustrated in FIGS. 9 and 10 have been described as each having the annular portion 44*a* which is severed at two locations, the annular portion 44*a* may be severed at a single location.

The sealing structure illustrated in each of FIGS. 8, 9 and 10 is assembled with the control element 24 (FIG. 7) in the following manner. That is, various sealing portions of the sealing member 31 are first fitted into the respective grooves 33, 34, 35, 35 and 36, 36 provided in the control element 24, and various sealing portions of the auxiliary sealing member 44 are then superposed upon the respectively corresponding sealing portions of the sealing member 31 and are fitted into the aforesaid respective grooves in the control element 24. Thus, the assemblage is completed. At this time, the various sealing portions of the auxiliary sealing member 44 slightly project from the respective grooves in the control element 24.

As described above, according to the variable capacity vane compressor of the present invention, since the control element is controlled by the pressure within the compressor, the compressor can be simple in construction and compact in size, thus facilitating assemblage of the compressor and reducing the manufacturing cost. Further, according to the first embodiment of the invention, when the discharge capacity of the compressor is to be changed from a greater value to a smaller value, the high pressure within the supply of high pressure into the second pressure chamber is interrupted and simultaneously the pressure within the second pressure chamber is allowed to leak into the low-pressure zone or suction chamber, whereby the compressor capacity can be varied with high responsiveness and controlled with high reliability. Furthermore, the pressure chambers form part of the passageway for relieving the high pressure into the low pressure zone, thus enabling to make the capacity control machanism more compact in size, which is advantageous to a compressor of this kind which generally undergoes limitations in mounting space.

According to the first and second embodiments as well as the variations thereof of the invention, since the sealing member is disposed on the axial one end face and inner and outer peripheral surfaces of the control element, it is possible to increase the pressure-receiving areas of the respective pressure-receiving protuberances with respect to the sealing line length. Consequently, it is made possible to restrain the hysteresis so that the controllability is enhanced. Moreover, since it suffices for the dimension control of the sealing member that only the diameter dimension of the sealing portions is controlled, the manufacturing accuracy is relieved. Further, when the auxiliary sialing member formed of Teflon or the like is superposed upon the sealing member to reduce the sealing resistance thereof, the auxiliary sealing member is prevented from being separated from the sealing member even if the third sealing portions thereof contract.

FIGS. 11 through 17 show a third embodiment of the invention, in which tapered sections are provided respectively at the bottoms of the respective opposite ends of the groove extending along the outer peripheral edge of each of the pressure-receiving protuberances on the control element, and complementary tapered sections are provided respectively at the opposite ends of each of the thied sealing portions of the sealing member, which attempt to further enhance the sealing effects. Other feature, arrangement and function of the third embodiment are substantially the same as those of the aforementioned first embodiment, and will not therefore be described.

As illustrated in FIGS. 11, 12 and 14(A), a resilient sealing member 60 is composed of a first sealing portion 61, a pair of second sealing portions 62 and 62 and a pair of third sealing portions 63 and 63, which are similar to those of the first embodiment, as well as a pair of fourth sealing portions 64 and 64 each of which comprises a pair of vertical parts **63*a* and 63*a* slightly rising, respectively, from the first sealing portion 61 and the other end of the corresponding second sealing portion 62, and a horizontal part 63*b* connecting the vertical parts 63*a* and 63*a*** to each other.

As shown in FIGS. 12 and 14(A), each of the pressure-receiving protuberances 26 is machined such that bottoms of the respective opposite ends of the generally U-shaped groove 35 formed in the peripheral edge of the protuberance 26 are tapered to respectively form tapered sections **26*c* and 26*c* each having an inclination of about 10 degrees with respect to the adjacent bottom surface of the groove 35**.

As illustrated in FIGS. 12 and 13, the inward surfaces of the respective lower ends of the respective vertical parts **63*a* and 63*a* of each of the third sealing portions 63 are formed respectively with tapered sections 63*c* and 63*c* which abut respectively against the corresponding tapered sections 26*c* and 26*c* and each of which has an inclination of about 10 degrees with respect to the adjacent section of the corresponding vertical part 63*a***.

By virtue of the provision of such tapered sections **26*c*, 26*c*, 63*c* and 63*c*, the tapered sections 63*c* and 63*c* abut against the respective tapered sections 26*c* and 26*c* without gaps therebetween as illustrated in FIGS. 14(B), 15(B) and 16(B) when each of the third sealing portions 63 is fitted in the corresponding groove 35 of the control element 24, not only in case where, as shown in FIG. 14(A), a central panel portion 26*a* formed when machining the groove 35 in each of the pressure-receiving protuberances 26 has a lateral width of a predetermined regular dimension X, but also in cases where, as shown in FIG. 15(A), the central panel portion 26*a* is erroneously machined 0 10 to have the lateral width of a dimension X' smaller than the predetermined dimension X, and as shown in FIG. 16(A), the central wall portion 26*a* is erroneously machined to have the lateral width of a dimension X'' larger than the predetermined dimension X. In case where no tapered sections 63*c*, 63*c* and 26*c*, 26*c* are provided as is in the first embodiment, respective gaps would be formed between the vertical parts 63*a* and 63*a* of each of the third sealing portions 63 and the side edges of the corresponding central panel portion 26*a*, if the central panel portion 26*a* is machined to have the lateral width of the smaller dimension X', and respective gaps would be formed between the first sealing portion 61 and the groove 33 and between each of the second sealing portion 62 and the corresponding groove 34, if the central panel portion 26*a*** is machined to have its lateral width of the larger dimension X''.

With the variable capacity vane compressor according to the above-described third embodiment, since the tapered sections of the respective vertical parts of each of the third sealing portions of the sealing member abut against the respective tapered sections at the bottoms of the respective opposite ends of the groove extending along the outer peripheral edge of the corresponding pressure-receiving protuberance, no gaps are formed between the respective grooves in the control element and the respective sealing portions of the sealing member even if variation occurs in the dimension of the various portions of the control element due to the machining errors. Thus, the sufficient sealing performance is ensured, making it possible for the control element to reliably operate, to thereby enable the compressor performance to be enhanced.

FIGS. 17 through 23 show fourth and fifth embodiments of the invention, which are different from the above-mentioned first embodiment in that the first sealing portion of the sealing member employed in the first embodiment is formed into an arc to reduce the sealing line length of the first sealing portion to thereby reduce the sliding resistance between the first sealing portion and the annular recess formed in the side block. Other feature, arrangement and function of the fourth and fifth embodiments are substantially the same as those of the first embodiment, and will not therefore be described.

The fourth embodiment will first be described with reference to FIGS. 17 through 22.

As illustrated in FIGS. 17 and 19, a sealing structure 150 is mounted to the control element 24. The sealing structure 150 is composed of a pair of resilient sealing members 161 and 162 formed of an elastic material such as rubber or the like, and a pair of auxiliary sealing members 171 and 172 formed of fluorocarbon resin such as Teflon or the like and forme into their respective configurations substantially identical with those of the respective resilient sealing members 161 and 162.

As shown in FIGS. 19, 20 and 21(A), each of the resilient sealing members 161 and 162 is composed of a first arcuate sealing portion **161*a*, 162*a*, a second sealing portion 161*b*, 162*b* similar to the first embodiment, a third sealing portion 161*c*, 162*c* formed by a pair of vertical parts extending substantially vertically, respectively, from one end of the second sealing portion 161*b*, 162*b* and from one end of the first sealing portion 161*a*, 162*a*, and a horizontal part connecting the vertical parts to each other, and a fourth sealing portion 161*d*, 162*d* formed by a pair of vertical parts slightly rising respectively from the other ends of the respective first and second sealing portions 161*a*, 162*a* and 161*b*, 162*b***, and a horizontal part connecting the vertical parts to each other.

Each of the auxiliary sealing members 171 and 172 illustrated in FIGS. 19 and 21(B) is adapted to be superposed upon the corresponding resilient sealing member 161, 162, as shown in FIG. 21(C), and is formed into a configuration substantially identical with that of the corresponding resilient sealing member 161, 162. Specifically, each of the auxiliary sealing members 171, 172 is composed of a first sealing portion 171*a*, 172*a*, a second sealing portion 171*b*, 172*b*, a third sealing portion 171*c*, 172*c* and a fourth sealing portion 171*d*, 172*d*, which respectively cover the corresponding sealing portions of a corresponding on of the resilient sealing members 161 and 162.

As illustrated in FIGS. 17 and 22, a lip seal 180 is mounted on the peripheral wall surface of the central bore 32 in the control element 24, for air-tightly sealing between the axial end face (high pressure side) of the control element 24 on the side of the rotor 10 and the other axial end face (low pressure side) thereof. The lip seal 180 is formed into a generally U-shape in cross-section, and is disposed such that the opening end face of the U-shape in cross-section is directed toward the axial end face of the rotor 10.

By virtue of the sealing member 150 and the lip seal 180, the air-tight sealing is achieved between the respective first pressure chambers $27_1$, and the respective second pressure chambers $27_2$, as shown in FIG. 18, between the respective inner and outer peripheral surfaces of the control element 24 and the respective inner and outer peripheral side wall surfaces of the annular recess 22 in the rear side block 9, and between the low and high pressure sides of the control element 24, as shown in FIGS. 17 and 19.

Assembling procedure of the lip seal 180 and the sealing structure 150 will next be described.

At the outset, the lip seal 180 is fitted onto the peripheral wall surface of the central bore 32 in the control element 24, and the various sealing portions 161*a*, 162*a*, 161*b*, 162*b*, 161*c*, 162*c* and 161*d*, 162*d* of the respective resilient sealing members 161 and 162 are fitted respectively into the grooves 33, 34, $35_1$, $35_2$ and $36_1$, $36_2$ in the control element 24.

Then, the third sealing portion 171*c* of the auxiliary sealing member 171 is covered on the third sealing portion 161*c* of the resilient sealing member 161. subsequently, the first, second and fourth sealing portions 171*a*, 171*b* and 171*d* of the auxiliary sealing member 171 are superposed upon the first, second and fourth sealing portions 161*a*, 161*b* and 161*d* of the resilient sealing member 161, respectively, while stretching the auxiliary sealing member 171, and thereafter, the worker releases his hand from the auxiliary sealing member 171. Thus, as shown in FIG. 21(C), the auxiliary sealing member 171 is fitted on the resilient sealing member 161, with the various sealing portions of the auxiliary sealing member 171 being superposed respectively upon the various sealing portions of the resilient sealing member 161. By the similar procedure, the auxiliary sealing member 171 is fitted on the resilient sealing member 162. In this manner, the assemblage of the lip seal 180 and the sealing structure 150 is completed.

In the above-described fourth embodiment, if the pair of resilient sealing members 161 and 162 have the same configuration and if the pair of auxiliary sealing members 171 and 172 have the same configuration, it is possible to improve the manufacturing efficiency of the resilient sealing members 161 and 162 and the auxiliary sealing members 171 and 172, to thereby reduce the manufacturing cost.

In the above-described fourth embodiment, the sealing structure 150 is formed by the pair of resilient sealing members 161 and 162 and the pair of auxiliary sealing members 171 and 172, and the pair of auxiliary sealing members 171 and 172 are interposed between the pair of resilient sealing members 161 and 162 and the mating sealing surfaces, for example, the inner and outer peripheral side wall surfaces of the annular recess 22 in the rear side block 9. With this arrangement, the entire surfaces of the pair of resilient sealing members 161 and 162 which are in sliding contact with the mating component parts are covered with the pair of auxiliary sealing members 171 and 172. Thus, the sliding resistance is extremely reduced so that the rotation of the control element 24 is effected smoothly, and the controllability is improved.

In the above-described fourth embodiment, the lip seal 180 angulary moves with the control element 24 and, therefore, the lip seal 180 provides no sliding resistance against the control element 24.

The fifth embodiment will next be described with reference to FIG. 23.

In the fifth embodiment, a lip seal 180′ for sealing between the low and high pressure sides of the control element 24 is received in a recess 10*a* formed in the axial end face of the rotor 10 on the side of the control element 24. Other construction of the fifth embodiment is similar to that of the above-described fourth embodiment.

Like the fourth embodiment, also in the fifth embodiment, the lip seal 180′ angularly moves with the control element 24 and, therefore, the lip seal 180′ provides no sliding resistance against the control element 24.

The fourth and fifth embodiment of the invention constructed as described above have the following advantages. That is, by virtue of the fact that the first sealing portion of each of the pair of resilient sealing members, which seals between the inner peripheral surface of the control element and the inner peripheral side wall surface of the annular recess in the rear side block, is formed into an arc, the sealing line length is reduced so that the sliding resistance between the first sealing portion and the annular recess is reduced and the resistance against the control element is reduced, to thereby improve the controllability, making it possible to enhance the compressor performance. Further, when the first sealing portion of each of the auxiliary sealing members, which is likewise formed into an arc, is superposed upon and assembled with the first arcuate sealing portion of the corresponding resilient sealing member, the first arcuate sealing portion of the resilient sealing member can provide the first sealing portion of the auxiliary sealing member with an escaping room, so that the assemblage is facilitated. Moreover, the inner radius of the first arcuate sealing portion of each of the auxiliary sealing members is not brought to such a size as to be force-fitted with respect to the diameter of the inner peripheral side wall surface of the annular recess, so that the sliding resistance between the inner peripheral side wall surface and the first arcuate sealing portion of each of the auxiliary sealing member is reduced. Thus, the resistance against the angular movement of the control element is reduced to thereby enhance the controllability, making it possible to improve the compressor performance.

FIGS. 24 through 32 show a sixth embodiment of the invention which is different from the above-described first embodiment in that a pair of flexible lips are provided respectively on the opposite side edges of each of the third sealing portions of the auxiliary sealing member. Other feature, arrangement and function of the sixth embodiment are substantially the same as those of the first embodiment, and will not therefore be described.

As illustrated in FIGS. 24 and 25, a pair of flexible lips 275 are provided in an integral manner respectively on opposite side edges of each of third sealing portions 273 of an auxiliary sealing member 270, along the entire lengths of the side edges. Each of the lips 275 is composed of a pair of lip portions 275*a* and 275*a* provided respectively at both vertical parts 273*a* and 273*a* of the corresponding third sealing portion 273, a pair of lip portions 275*b* and 275*b* provided respectively at corners 273*b* and 273*b* of the corresponding third sealing portion 273, and a lip portion 275*c* provided at a horizontal part 273*c* connecting the vertical parts 273*c* and 273*c* to each other. Each of the lip portions 275*a* is tapered so as to have its height gradually increasing from the lowermost point to the uppermost point of the corresponding vertical part 273*a*, in order to provide a draft utilized when the auxiliary sealing member 270 is injection-molded. The lip portions 275*b*, 275*b* and 275*c* have substantially equal heights. The lip portions 275*a*, 275*a*, 275*b*, 275*b* and 275*c*, 275*c* at the respective opposite side edges of each of the third sealing portions 273 become narrower and narrower toward their respective tips and extend away from each other, as shown in FIG. 26 which illustrates only the lip portions 275*c* and 275*c*, so that these lip portions tend to be deformed when urged.

If the auxiliary sealing member 270 is formed using a plurality of divided molds, not by means of the injection-molding, the lip portions 275*a* and 275*a* are not required to be tapered.

Like the third sealing portion 273 and 273, flexible lips 276 are provided in an integral manner respectively on the opposite side edges of each of the fourth sealing portions 274 and 274, along the entire lengths of the side edges.

When the control element 24 having the resilient sealing member 260 mounted thereon and the auxiliary sealing member 270 are assembled with the rear side block 9, the third sealing portions 273 of the auxiliary sealing member 270 are fitted into the annular recess 22 in the rear side block 9, as shown in FIG. 27, so that the lip portions 275*a*, 275*b* and 275*c* of the lips 275 provided on each of the third sealing portions 273 are urged against the wall surfaces of the annular recess 22.

At this time, the lip portions 275*a* provided on each of the vertical parts 273*a* and 273*a* of each of the third sealing portions 273 are spreaded away from each other and are crushed, because the outer surface 273*a*' of the vertical part 273*a* is brought into intimate contact with the outer peripheral side wall surface 22*a* of the annular recess 22, as shown in FIG. 28, so that the lip portions 275*a* are brought into intimate contact with a corresponding one of the inner and outer peripheral side wall surfaces 22*b* and 22*a*. The lip portions 275*c* (cf. FIG. 25) provided on each of the horizontal parts 273*c* are also spreaded and crushed like the lip portions 275*a*, so that the lip portions 275*c* are brought into intimate contact with the bottom wall surface 22*c* of the annular recess 22. The lip portions 275*b* provided on the corners 273*b* and 273b of the third sealing portion 273 are not deformed unlike the lip portions 275*a* and 275*c*, because gaps Y as shown in FIGS. 27 and 29 are present respectively between the corners 22*d* and 22*d* of the annular recess 22 and the corners 273*b* and 273*b* of each of the third sealing portions 273. The lip portions 275*b* are slightly deformed as shown in FIG. 29 in such a manner that their respective tips are urged against the corners 22*d*.

In this manner, even if the gaps Y are formed respectively between the corners 22*d* of the anuular recess 22 and the corners 273*b* of each of the third sealing portions 273*b*, the tips of the respective lip portions 275*b* are urged against the corners 22*d* to close the gap Y. Thus, gas is prevented from leaking through the gaps Y, and sufficient air-tightness is maintained.

Likewise, as described above, the lips 276 are also provided between the corners of the annular recess 22 and the corners of each of the fourth sealing portions of the auxiliary sealing member 270. Accordingly, even if gaps are formed respectively between the corners of each of the fourth sealing portions 274 and the corners of the annular recess 22, the lips 276 close the gaps to enable sufficient air-tightness to be maintained.

According to the sixth embodiment, the lip portions 275*a*, 275*a* and 275*c* are respectively provided on the vertical parts 273*a* and 273*a* and the horizontal part 273*c* of each of the third sealing portion 273. Consequently, even if slight gaps due to manufacturing errors are formed respectively between one of the vertical parts 273*a* and the outer peripheral side wall surface 22*a* of the annular recess 22, between the other vertical part 273*a* and the inner peripheral side wall surface 22*b* of the annular recess 22, and between the horizontal part 273*c* and the bottom wall surface 22*c* of the annular recess 22, these gaps are closed by the lip portions 275*a*, 275*a* and 275*c*, respectively. Thus, the air-tightness can still more be maintained.

The sixth embodiment has been described as having the lips 276 provided on each of the fourth sealing portions 274 of the auxiliary sealing member 270. the present invention should not be limited to this specific form, but may be arranged such that the lips are provided only on the third sealing portions 273 of the auxiliary sealing member 270.

The lips 275 provided on each of the third sealing portions 273 of the auxiliary sealing member 270 should not be limited to the configuration illustrated in FIG. 26, but may have various configurations as shown in FIGS. 30, 31 and 32.

According to the above-described sixth embodiment, since the flexible lips are provided respectively on the opposite side edges of each of the third sealing portions of the auxiliary sealing member, gaps formed due to inconsistency in configuration between the corners of the annular recess and the corners of each of the third sealing portions are closed by the lips. Thus, sufficient air-tightness can be maintained, to thereby enhance the controllability of the compressor.

Although the second to sixth embodiments have been described as each having the auxiliary sealing member formed of fluorocarbon such as Teflon or the like, the auxiliary sealing member may be formed of any material if it has low coefficient of friction and has smooth sliding surfaces. The auxiliary sealing member may be formed of iron press-worked, for example.

Further, although the second to sixth embodiments have been described as each having the sealing structure which is comprised of the resilient sealing member and the auxiliary sealing member, the invention should not be limited to this specific form. It is needless to say that the sealing structure may be formed by only the resilient sealing member.

Moreover, the third to sixth embodiments have been described as each having the sealing member including the fourth sealing portions each of which is composed of the pair of vertical parts slightly rising respectively from the first sealing portion and the other end of each of the second sealing portions, and the horizontal part connecting the vertical parts to each other, to enhance the sealing performance. However, like the first embodiment, the fourth sealing portions may be formed such that they extend substantially in flush with the first and second sealing portions.

What is claimed is:

1. A variable capacity vane compressor comprising:

a cylinder formed by a cam ring and a pair of front and rear side blocks respectively closing opposite axial ends of said cam ring, one of said front and rear side blocks having at least one first inlet port, said at least one inlet port having a first portion and a second portion;

a rotor rotatably received within said cylinder, said one side block having an axial end face facing toward said rotor and an annular recess formed in said axial end face in substantially concentric relation to an axis of said one side block;

a plurality of vanes radially slidably fitted in slits formed in said rotor;

a low and a high pressure chamber;

said cylinder, said rotor and the adjacent vanes cooperating with each other to defince a plurality of compression chambers which change in their respective volumes, as said rotor rotates, so that a compression medium is successively drawn into said compression chambers from said low pressure chamber through said first inlet port, and the drawn medium is compressed within said compression chambers and is discharged therefrom;

said second portion of said at least one inlet port communicating with said low pressure chamber and with at least one of said compression chambers which is on a suction stroke;

at least one space provided in said one side block and communicating with said low and high pressure chambers;

a control element for controlling an opening degree of said second porion of said at least one inlet port, said control element including at least one pressure-receiving protuberance slidably fitted in said space to divide same into a first pressure chamber communicating with said low pressure chamber and a second pressure chamber communicating with said high pressure chamber and capable of communicating with said low pressure chamber, said pressure-receiving protuberance having formed therein a groove extending along an outer peripheral edge of said pressure-receiving protuberance, said control element having a central bore, an annular groove formed in a peripheral wall surface of said central bore, at least one generally radially extending groove formed in an axial end face of said control element, and at least one peripherally extending, arcuate groove formed in an outer peripheral surface of said control element;

said control element angularly moving in response to a differential pressure between said first and second pressure chambrs acting upon said pressure-receiving protuberance, for controlling the opening degree of said second portion of said at least one inlet port, thereby controlling a compression commencing timing of the compressor to control a delivery quantity thereof;

a communication passageway communicating said second pressure chamber and said low pressure chamber with each other;

valve means provided in said communication passageway for opening and closing same, said valve means being operable to close said communication passageway when the pressure within said low pressure chamber is above a predetermined value, and to open said communication passageway when the pressure within said low pressure chamber is below said predetermined value; and sealing means mounted on said control element for sealing between said first and second pressure chambers and between said low pressure chamber and a zone of a back pressure acting upon said vanes, said sealing means comprising a first annular sealing portion fitted in said annular groove formed in the peripheral wall surface of said central bore in said control element for sealing between the peripheral wall surface of said central bore and an inner peripheral side wall surface of said annular recess in said one side block, a second sealing portion cencentric with said first sealing portion and fitted in said arcuate groove formed in the outer peripheral surface of said control element for sealing between the outer peripheral surface of said control element and an outer peripheral side wall surface of said annular recess in said one side block, a third sealing portion provided in a manner integral with one end of said second sealing portion and said first sealing portion to connect them with each other, said third sealing portion being fitted in said groove extending along the outer peripheral edge of said pressure-receiving protuberance for sealing between the outer peripheral edge of said pressure-receiving protuberance and the inner and outer peripheral wall surfaces and a bottom wall surface of said annular recess in said one side block and an inner wall surface of said space, and a fourth sealing portion provided in a manner integral with said first sealing portion and the other end of said second sealing portion to connect them with each other, said fourth sealing portion being fitted in said groove formed in the axial end face of said control element for sealing between the axial end face of said control element and the bottom wall surface of said annular recess in said one side block.

2. A variable capacity vane compressor as defined in claim 1, wherein said sealing means comprises a resilient sealing member and an auxiliary sealing member formed into substantially the same configuration as said resilient sealing member, said auxiliary sealing member having a plurality of portions corresponding respectively to said first to fourth sealing portions, said portions of said auxiliary sealing member having respective one side surfaces thereof superposed upon said resilient sealing member, and said portions of said auxiliary sealing member having respective other side surfaces thereof smoothened.

3. A variable capacity vane compressor as defined in claim 2, wherein said auxiliary sealing member is divided into two pieces at locations on said first sealing portion which are positioned in circumferentially substantially symmetric relation to each other, gaps being provided respectively between opposed ends of said two pieces.

4. A variable capacity vane compressor as defined in claim 3, wherein said gaps each extend in the form of a straight line.

5. A variable capacity vane compressor as defined in claim 3, wherein said gaps are each in the form of a generally L-shape.

6. A variable capacity vane compressor comprising:

a cylinder formed by a cam ring and a pair of front and rear side blocks respectively closing opposite axial ends of said cam ring, one of said front and rear side blocks having a pair of first inlet ports, said pair of inlet ports each having a first portion and a second portion;

a rotor rotatably received within said cylinder, said one side block having an axial end face facing toward said rotor and an annular recess formed in said axial end face in substantially concentric relation to an axis of said one side block;

a plurality of vanes radially slidably fitted in slits formed in said rotor;

a low and a high pressure chamber;

said cylinder, said rotor and the adjacent vanes cooperating with each other to define a plurality of compression chambers which change in their respective volumes, as said rotor rotates, so that a compression medium is successively drawn into said compression chambers from said low pressure chamber through said first inlet ports, and the drawn medium is compressed within said compression chambers and is discharged therefrom;

said second portions of said inlet ports communicating with said low pressure chamber and respectively with two of said compression chambers which are on a suction stroke;

a pair of spaces provided in said one side block and each communicating with said low and high pressure chambers;

a control element for controlling opening degrees of the respective second portions of said inlet ports, said control element including a pair of pressure-receiving protuberances each slidably fitted in a corresponding one of said spaces to divide same into a first pressure chamber communicating with said low pressure chamber and a second pressure chamber communicating with said high pressure chamber and capable of communicating with said low pressure chamber, each of said pressure-receiving protuberances having formed therein a groove extending along an outer peripheral edge of the pressure-receiving protuberance, said control element having a central bore, a pair of arcuate grooves formed in a peripheral wall surface of said central bore, a pair of generally radially extending grooves formed in an axial end face of said control element, and a pair of peripherally extending, arcuate grooves formed in an outer peripheral surface of said control element;

said control element angularly moving in response to a differential pressure between said first and second pressure chambers acting upon each of said pressure-receiving protuberances, for controlling the opening degrees of the respective second portions of said inlet ports, thereby controlling a compression commencing timing of the compressor to control a delivery quantity thereof;

a communication passageway communicating the respective second pressure chambers and said low pressure chamber with each other;

valve means provided in said communication passageway for opening and closing same, said valve means being operable to close said communication passageway when the pressure within said low pressure chamber is above a predetermined value, and to open said communication passageway when the pressure within said low pressure chamber is below said predetermined value; and a pair of sealing means mounted on said control element for sealing between the respective first pressure chambers and the respective second pressure chambers and between said low pressure chamber and a zone of a back pressure acting upon said vanes, each of said sealing means comprising a first arcuate sealing portion fitted in a corresponding one of said annular grooves formed in the peripheral wall surface of said central bore in said control element for sealing between the peripheral wall surface of said central bore and an inner peripheral side wall surface of said annular recess in said one side block, a second sealing portion concentric with said first sealing portion and fitted in a corresponding one of said arcuate grooves formed in the outer peripheral surface of said control element for sealing between the outer peripheral surface of said control element and an outer peripheral side wall surface of said annular recess in said one side block, a third sealing portion provided in a manner integral with one end of said second sealing portion and said first sealing portion to connect them with each other, said third sealing portion being fitted in said groove extending along the outer peripheral edge of a corredponsing one of said pressure-receiving protuberances for sealing between the outer peripheral edge of the pressure-receiving protuberance, and the inner and outer peripheral wall surfaces and a bottom wall surface of said annular recess in said one side block and an inner wall surface of a corresponding one of said spaces, and a fourth sealing portion provided in a manner integral with said first sealing portion and the other end of said second sealing to connect them with each other, said fourth sealing portion being fitted in a corresponding one of said grooves formed in the axial end face of said control element for sealing between the axial end face of said control element and the bottom wall surface of said annular recess in said one side block.

7. A variable capacity vane compressor as defined in claim 6, wherein said pair of sealing means comprise a pair of resilient sealing members and a pair of auxiliary sealing members formed into substantially the same configuration as said resilient sealing members, each of said auxiliary sealing members having a plurality of portions corresponding respectively to said first to fourth sealing portions, said portions of the auxiliary sealing member having respective one side surfaces thereof superposed upon a corresponding one of said resilient sealing members, and said portions of the auxiliary sealing member having respective other side surfaces thereof smoothened.

8. A variable capacity vane compressor as defined in claim 1 or claim 6, wherein said third sealing portion of said sealing means comprises a pair of vertical parts extending respectively from said first sealing portion and the one end of said second sealing portion and a horizontal part connecting said vertical parts with each other, said groove along the outer peripheral edge of said pressure-receiving protuberance having opposite ends which have respective patered bottom surfaces, said pair of vertical parts of said third sealing portion having respective patered ends respectively adjacent said first and second sealing portions, said tapered ends abutting respectively against said tapered bottom surfaces.

9. A variable capacity vanee compressor as defined in any one of claims 1 to 7, wherein said fourth sealing portion comprises a pair of vertical parts slightly rising respectively from said first sealing portion and the other end of said second sealing portion, and a horizontal part connecting said vertical parts of said fourth sealing portion with each other.

10. A variable capacity vane compressor as defined in any one of claims 1 to 7, wherein said sealing means includes a pair of flexible lips provided respectively on opposite side edges of at least selected one of said first to fourth sealing portions of said sealing means.

11. A variable capacity vane compressor as defined in claim 9, wherein said selected sealing portion is said third sealing portion.

* * * * *